US012330038B2

(12) United States Patent
Boisture

(10) Patent No.: US 12,330,038 B2
(45) **Date of Patent: *Jun. 17, 2025**

(54) SUPPORT SYSTEM FOR USE WITH A TACKLING APPARATUS

(71) Applicant: Athletic Technologies LLC, Grand Blanc, MI (US)

(72) Inventor: Martin Boisture, Grand Blanc, MI (US)

(73) Assignee: Athletic Technologies LLC, Grand Blanc, MI (US)

( * ) Notice: Subject to any disclaimer, the term of this patent is extended or adjusted under 35 U.S.C. 154(b) by 24 days.

This patent is subject to a terminal disclaimer.

(21) Appl. No.: 18/216,728

(22) Filed: Jun. 30, 2023

(65) Prior Publication Data

US 2023/0338808 A1 Oct. 26, 2023

Related U.S. Application Data

(63) Continuation of application No. 17/567,271, filed on Jan. 3, 2022, now Pat. No. 11,691,062, which is a (Continued)

(51) Int. Cl.

| | |
|---|---|
| ***A63B 69/34*** | (2006.01) |
| ***A63B 69/24*** | (2006.01) |
| ***A63B 69/32*** | (2006.01) |

(52) U.S. Cl.

CPC ..... *A63B 69/244* (2022.08); *A63B 69/32* (2013.01); *A63B 69/34* (2013.01); *A63B 2209/08* (2013.01);

(Continued)

(58) Field of Classification Search

CPC ... A63B 69/34; A63B 2209/08; A63B 69/244; A63B 69/32

(Continued)

(56) References Cited

U.S. PATENT DOCUMENTS

| | | | |
|---|---|---|---|
| 650,008 | A | 5/1900 | Hamel |
| 704,265 | A | 7/1902 | McMaster |

(Continued)

FOREIGN PATENT DOCUMENTS

| | | | |
|---|---|---|---|
| CA | 2466435 | C | 3/2009 |
| KR | 102292173 | B1 | 8/2021 |

(Continued)

OTHER PUBLICATIONS

Penning, Craig, "evader tackling machine!" YouTube, Aug. 28, 2011, https://www.youtube.com/watch?v=a-mdJXIm4eY.

(Continued)

*Primary Examiner* — Mitra Aryanpour

(74) *Attorney, Agent, or Firm* — Harness, Dickey & Pierce, P.L.C.

(57) ABSTRACT

An apparatus includes a rolling mechanism and a pulley device. The rolling mechanism is connected to a cable and configured to traverse the cable from a first end of the cable toward a second end of the cable, the cable being attached to and extending between a pair of support members. The pulley device is removably coupled to the rolling mechanism and attached to a tackling bag, the tackling bag being configured to be tackled when propelled from the one of the pair of support members toward the other of the pair of support members. The pulley device is separated from the cable when the tackling bag is propelled from the one of the pair of support members toward the other of the pair of support members.

20 Claims, 19 Drawing Sheets

Related U.S. Application Data continuation of application No. 16/787,236, filed on Feb. 11, 2020, now Pat. No. 11,213,734.

(52) U.S. Cl.
CPC . *A63B 2225/093* (2013.01); *A63B 2243/0066* (2013.01); *A63B 2243/007* (2013.01)

(58) Field of Classification Search
USPC ..... 473/443
See application file for complete search history.

(56) References Cited

U.S. PATENT DOCUMENTS

| | | | | |
|---|---|---|---|---|
| 1,176,730 | A | 3/1916 | Ashton | |
| 1,204,017 | A | 11/1916 | Hinky | |
| 1,538,203 | A | 5/1925 | Moran | |
| 1,708,638 | A | 4/1929 | Smith | |
| 1,817,364 | A | 8/1931 | Goldsmith | |
| 1,909,461 | A | 5/1933 | Costa | |
| 2,153,384 | A | 4/1939 | Mazza | |
| 2,183,465 | A | 12/1939 | Noor | |
| 2,255,711 | A | 9/1941 | Noor | |
| 2,290,297 | A | 7/1942 | Smith | |
| 2,344,829 | A | 3/1944 | McAvoy | |
| 2,504,273 | A | 4/1950 | Murphy, Jr. | |
| 2,749,121 | A | 6/1956 | Myers | |
| 2,940,757 | A | 6/1960 | Britt | |
| 2,984,485 | A | 5/1961 | Brown | |
| 3,114,549 | A | 12/1963 | Hooker | |
| 3,140,874 | A | 7/1964 | Jensen et al. | |
| 3,337,217 | A | 8/1967 | Cummins | |
| 3,424,458 | A | 1/1969 | Hopps, Jr. | |
| 3,637,210 | A | 1/1972 | Brantley | |
| 3,659,847 | A | 5/1972 | Gow | |
| 3,659,848 | A | 5/1972 | DePew | |
| 3,836,147 | A | 9/1974 | Shapiro | |
| 4,890,495 | A | 1/1990 | Slane | |
| 5,152,733 | A | 10/1992 | Farenholtz et al. | |
| 5,688,196 | A | 11/1997 | O'Neil | |
| 5,897,466 | A | 4/1999 | Capach | |
| 6,050,906 | A | 4/2000 | Stout et al. | |
| 6,348,028 | B1 | 2/2002 | Cragg | |
| 6,375,584 | B1 | 4/2002 | Shapiro | |
| 7,736,248 | B2 | 6/2010 | Eldridge | |
| 8,790,198 | B1 | 7/2014 | Russell | |
| 8,808,115 | B2 | 8/2014 | DeTroia | |
| 9,879,949 | B2 | 1/2018 | Roemer | |
| 10,661,141 | B1 | 5/2020 | Boisture | |
| 11,213,734 | B2 * | 1/2022 | Boisture | A63B 69/34 473/443 |
| 11,691,062 | B2 * | 7/2023 | Boisture | A63B 69/34 473/443 |
| 2002/0077226 | A1 | 6/2002 | Ott | |
| 2002/0091043 | A1 | 7/2002 | Rexach | |
| 2004/0018920 | A1 | 1/2004 | Simonson | |
| 2007/0179030 | A1 | 8/2007 | Slawinski | |
| 2008/0039292 | A1 | 2/2008 | Ross | |
| 2008/0280703 | A1 | 11/2008 | Eldridge | |
| 2012/0309565 | A1 | 12/2012 | Ponstein | |
| 2019/0240555 | A1 | 8/2019 | Bognanno | |
| 2020/0269116 | A1 | 8/2020 | Boisture | |
| 2023/0338808 | A1 * | 10/2023 | Boisture | A63B 69/34 473/443 |

FOREIGN PATENT DOCUMENTS

| | | | |
|---|---|---|---|
| WO | WO-0137950 | A1 | 5/2001 |
| WO | WO-2010122540 | A2 | 10/2010 |
| WO | WO-2017173508 | A1 | 10/2017 |

OTHER PUBLICATIONS

International Search Report regarding International Application No. PCT/US2020/020093, dated Jun. 23, 2020.

Written Opinion regarding International Application No. PCT/US2020/020093, dated Jun. 23, 2020.

International Search Report and Written Opinion regarding International Application No. PCT/US2021/017499, dated Jun. 7, 2021.

International Preliminary Report on Patentability regarding International Patent Application No. PCT/US2020/020093, dated Aug. 25, 2021.

International Preliminary Report on Patentability regarding International Patent Application No. PCT/US2021/017499, dated Aug. 11, 2022.

* cited by examiner

SUPPORT SYSTEM FOR USE WITH A TACKLING APPARATUS

CROSS-REFERENCE TO RELATED APPLICATIONS

This application is a continuation of U.S. patent application Ser. No. 17/567,271, filed on Jan. 3, 2022, now U.S. Pat. No. 11,691,062 which is a continuation of U.S. patent application Ser. No. 16/787,236 filed on Feb. 11, 2020, now U.S. Pat. No. 11,213,734. The entire disclosure of the above application is incorporated herein by reference.

FIELD

The present disclosure relates to a tackling apparatus.

BACKGROUND

This section provides background information related to the present disclosure and is not necessarily prior art.

Football (i.e., American Football) or rugby, for example, involves substantial player on player physical contact. As is known, player on player physical contact may result in injuries and repeated contact during practice may elevate the risk of player injury. As such, player on player contact during practice has been limited (or prevented altogether).

As a result of limited player on player physical contact during practice, tackling apparatuses (e.g., a tackling dummy) are used to teach players proper tackling techniques and form without the need for player on player physical contact. However, such tackling apparatuses are not reliable and do not accurately simulate live game tackling. The present disclosure provides a tackling apparatus that is reliable and accurate simulates live game tackling.

SUMMARY

This section provides a general summary of the disclosure, and is not a comprehensive disclosure of its full scope or all of its features.

In one form, the present disclosure provides an apparatus that includes a pair of support members, a cable, a rolling mechanism, a tackling bag and a pulley device. The pair of support members are fixedly coupled to a surface. The cable is attached to and extending between the pair of support members. The rolling mechanism is connected to the cable and configured to traverse the cable from a first end of the cable toward a second end of the cable. The tackling bag is configured to be propelled from one of the pair of support members toward the other of the pair of support members. The tackling bag also is configured to be tackled when propelled from the one of the pair of support members toward the other of the pair of support members. The pulley device is removably coupled to the rolling mechanism and attached to the tackling bag. The pulley device is separated from the cable when the tackling bag is propelled from the one of the pair of support members.

In some configurations of the apparatus of the above paragraph, the pulley device is connected to the cable when the tackling bag is tackled.

In some configurations of the apparatus of any one or more of the above paragraphs, a magnet is attached to the rolling mechanism.

In some configurations of the apparatus of any one or more of the above paragraphs, the magnet is a neodymium magnet.

In some configurations of the apparatus of any one or more of the above paragraphs, a metallic plate is attached to the pulley device. The magnet and the metallic plate are attached to each other thereby causing the pulley device to be separated from the cable.

In some configurations of the apparatus of any one or more of the above paragraphs, a force applied to the tackling bag when tackled causes the metallic plate and the magnet to detach from each other.

In some configurations of the apparatus of any one or more of the above paragraphs, the pulley device is attached to the tackling bag via an attachment assembly.

In some configurations of the apparatus of any one or more of the above paragraphs, a first pulley system associated with the one of the pair of support members and a second pulley system associated with the other of the pair of support members. The cable extends around the first and second pulley systems.

In some configurations of the apparatus of any one or more of the above paragraphs, a first stack of weights attached to a pulley of the first pulley system and a second stack of weights attached to another pulley of the second pulley system. The first and second stack of weights cooperate to act as a counterbalance to the tackling bag such that the tackling bag is suspended above the surface prior to a force being applied to the tackling bag.

In another form, the present disclosure provides an apparatus that includes a pair of support members, a cable, a rolling mechanism, a tackling bag and a magnet. The pair of support members are fixedly coupled to a surface. The cable is attached to and extends between the pair of support members. The rolling mechanism is connected to the cable and configured to traverse the cable from a first end of the cable toward a second end of the cable. The tackling bag is configured to be propelled from one of the pair of support members toward the other of the pair of support members. The pulley device is removably coupled to the rolling mechanism and attached to the tackling bag. The magnet is coupled to the rolling mechanism and urges the pulley device away from the cable when the tackling bag is propelled from the one of the pair of support members toward the other of the pair of support members.

In some configurations of the apparatus of the above paragraph, the pulley device and tackling bag is unsupported by the cable when the tackling bag is propelled from the one of the pair of support members toward the other of the pair of support members.

In some configurations of the apparatus of any one or more of the above paragraphs, the rolling mechanism includes first, second and third wheel housings, and wherein the second and third wheel housings traverse the cable.

In some configurations of the apparatus of any one or more of the above paragraphs, the pulley device is configured to move downwardly relative to the first, second and third wheel housings when a force is applied to the tackling bag.

In some configurations of the apparatus of any one or more of the above paragraphs, the first, second and third wheel housing define a space. The magnet is received in the space and is attached to the first wheel housing.

In some configurations of the apparatus of any one or more of the above paragraphs, a housing member is disposed within the first wheel housing and attached to the first wheel housing. The magnet coupled to the housing member.

In some configurations of the apparatus of any one or more of the above paragraphs, a plurality of magnets are coupled to the rolling mechanism and urge the pulley device away from the cable when the tackling bag is propelled from the one of the pair of support members toward the other of the pair of support members.

In yet another form, that present disclosure discloses an apparatus that includes a pair of support members, a cable, a first rolling mechanism, a tackling bag and a utility bag. The pair of support members are fixedly coupled to a surface. The cable is attached to and extends between the pair of support members. The first rolling mechanism is connected to the cable and configured to traverse the cable from a first end of the cable toward a second end of the cable. The tackling bag is attached to the first rolling mechanism and configured to be propelled from one of the pair of support members toward the other of the pair of support members. The utility bag is coupled to the cable and configured to be propelled from one of the pair of support members toward the other of the pair of support members independently of the tackling bag.

In some configurations of the apparatus of the above paragraph, a second rolling mechanism is connected to the cable and configured to traverse the cable. The utility bag is coupled to the second rolling mechanism.

In some configurations of the apparatus of any one or more of the above paragraphs, the utility bag is heavier than the tackling bag.

In some configurations of the apparatus of any one or more of the above paragraphs, another cable is attached to and extends between the pair of support members. The first rolling mechanism is connected to the another cable and configured to traverse the another cable from a first end of the another cable toward a second end of the another cable.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
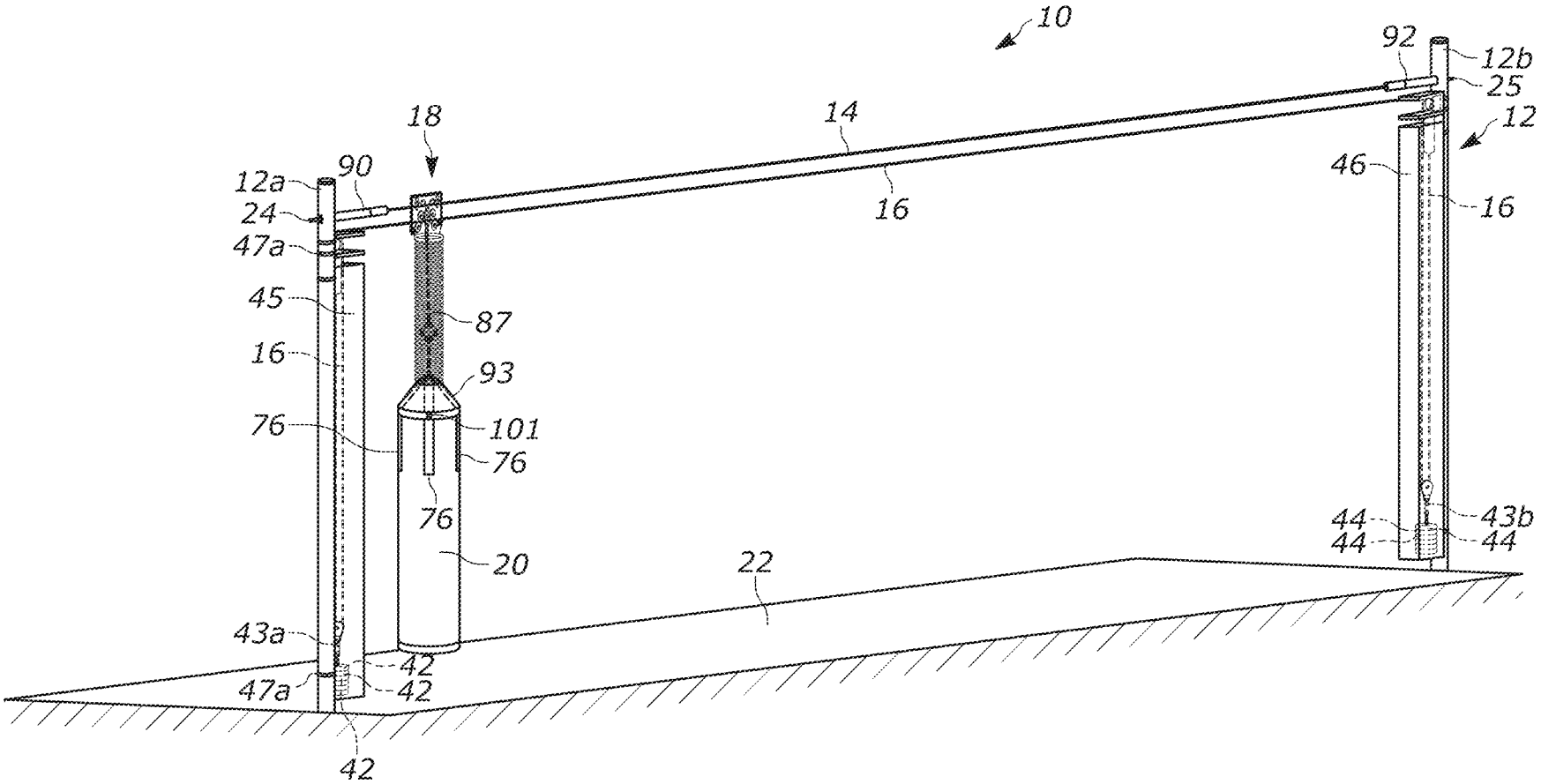
FIG. 1 is a perspective view of a tackling apparatus according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
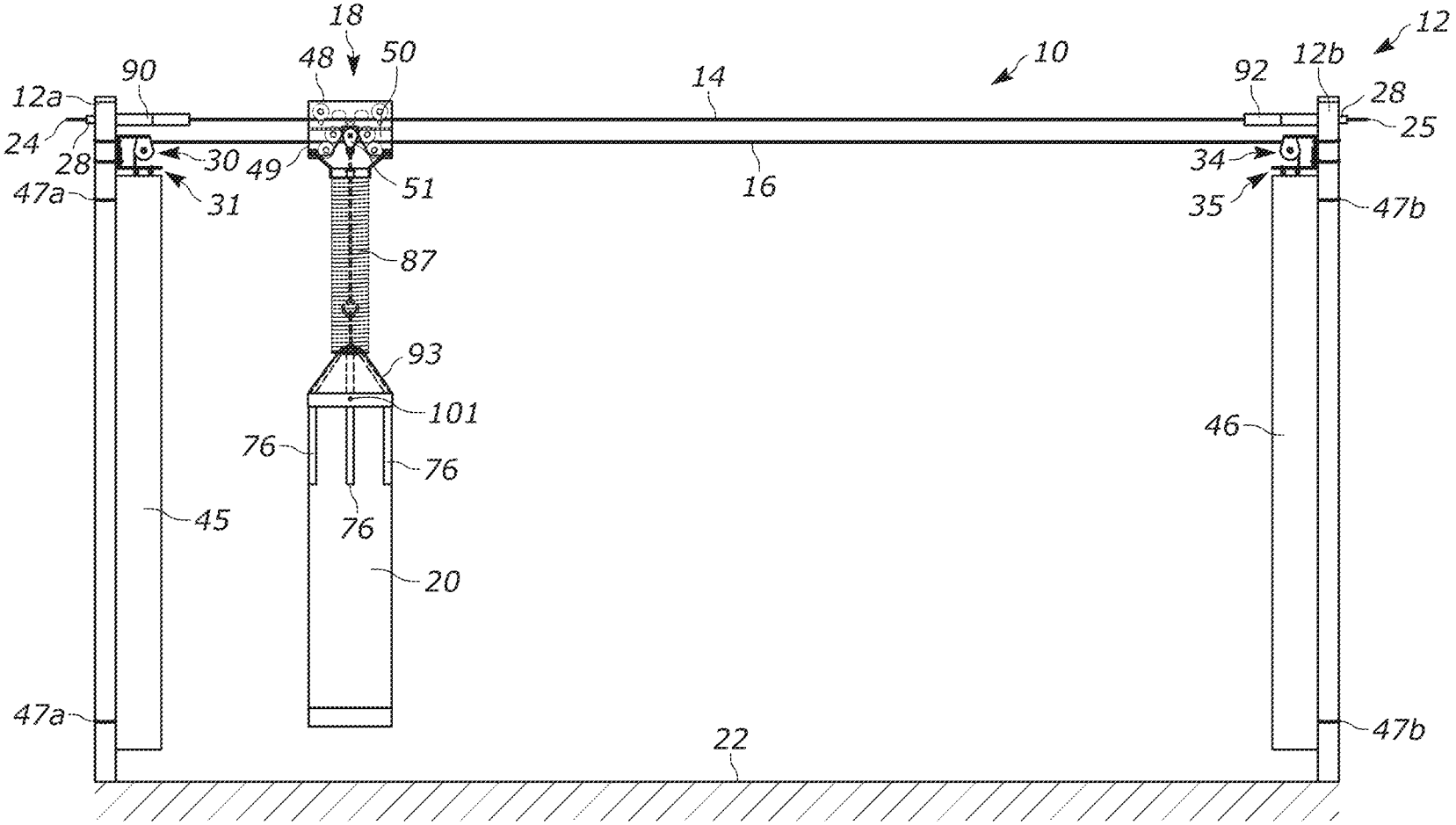
FIG. 2 is a front view of the tackling apparatus shown in FIG. 1 prior to a tackling bag of the tackling apparatus being propelled and tackled.

As shown in FIGS. 1 and 2, an apparatus 10 is provided that may include a pair of elongated support structures or members 12 (comprised of support member 12*a* and support member 12*b*), first and second cables 14, 16, a trolley or rolling mechanism 18 and an elongated tackling bag or body 20. The pair of support members 12 may be fixedly coupled to a surface 22 and may be aligned with each other. Each support member 12*a*, 12*b* may be cylindrically-shaped and may be made of a metallic material, for example. In some configurations, the pair of support members 12 may be telescoping such that a height that the tackling bag 20 is suspended above the surface 22 may be adjustable.

As shown in FIGS. 1 and 2, the first cable 14 may extend between the pair of support members 12 and may support the rolling mechanism 18. The first cable 14 may be rigid. With reference to FIGS. 1-6, a first end 24 of the first cable 14 may extend through an aperture (not shown) of the support member 12*a* (FIGS. 1-4) and a second end 25 of the first cable 14 may extend through an aperture (not shown) of the support member 12*b* (FIGS. 1, 2, 5 and 6). A fastening member 28 (e.g., locking nut) may be secured to the first and second ends 24, 25 of the first cable 14 to attach the first cable 14 to the pair of support members 12.

Figure 3:
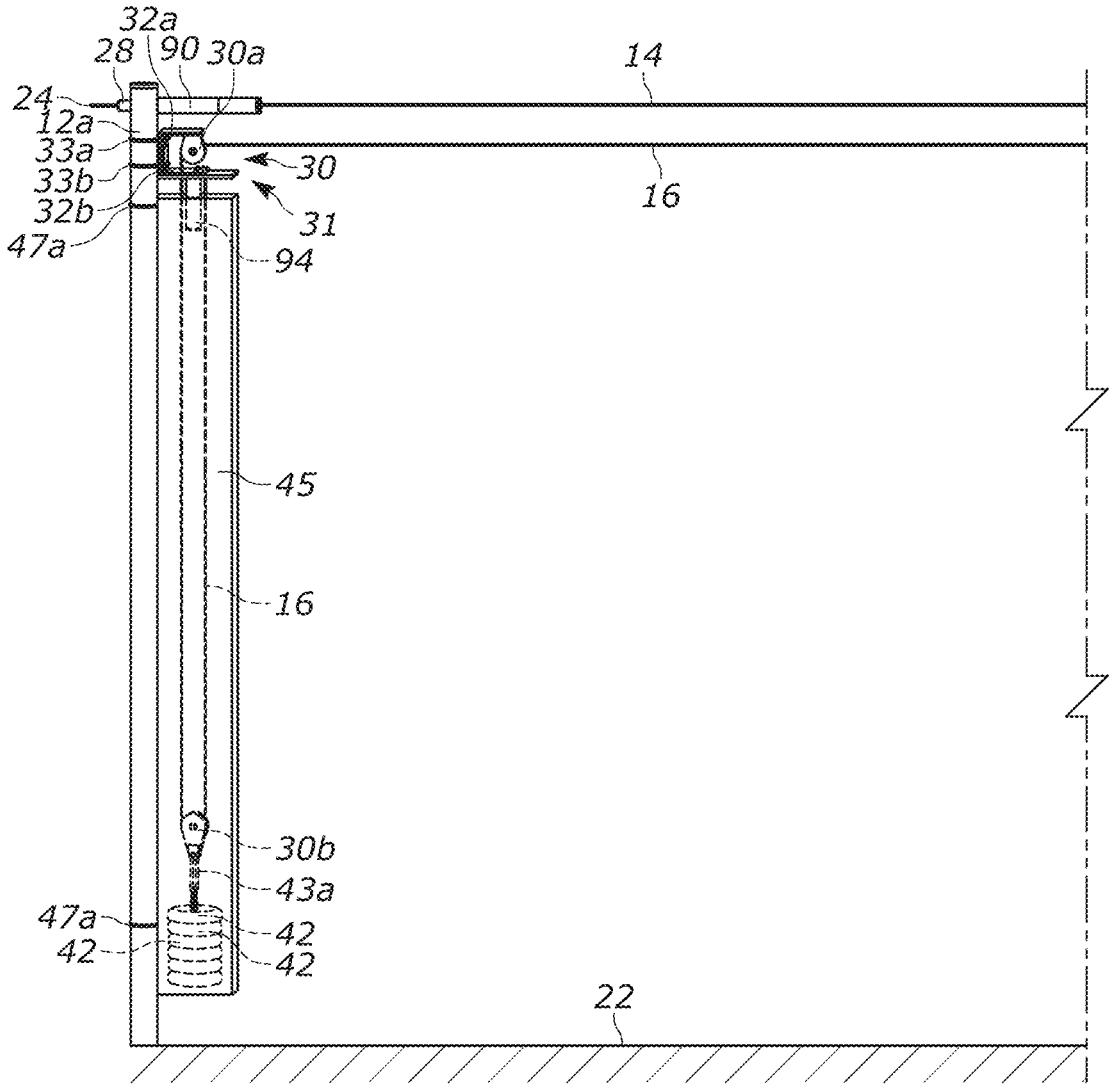
FIG. 3 is a front view of a first pulley system and a first support member of the tackling apparatus shown in FIG. 1.
Figure 4:
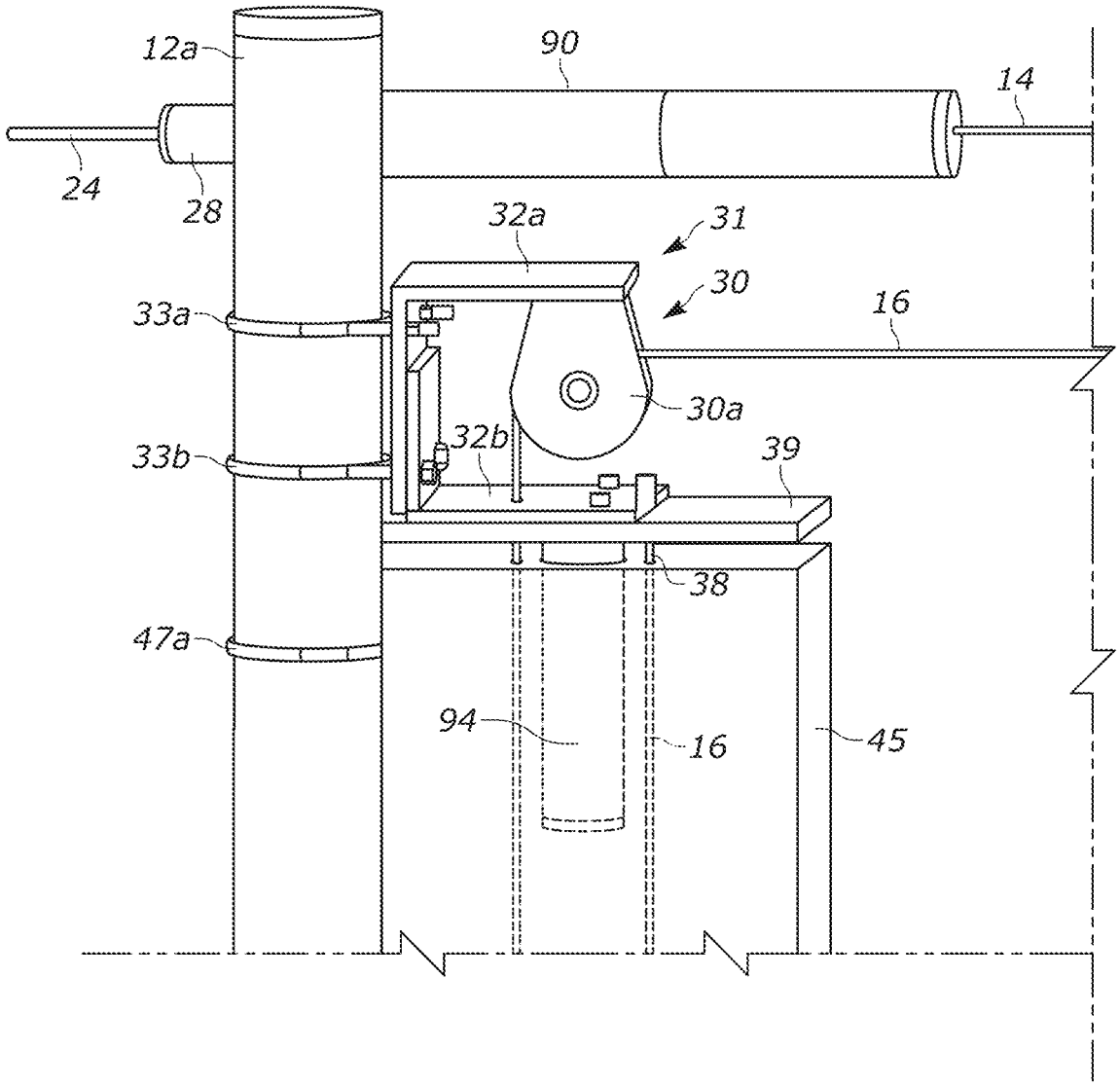
FIG. 4 is a front view of a bracket assembly of the tackling apparatus shown in FIG. 1.

With reference to FIGS. 3 and 4, a first pulley system 30 may be associated with the support member 12*a* and may include pulley devices 30*a*, 30*b*. The pulley device 30*a* may be attached to a bracket assembly 31, which, in turn, is coupled to the support member 12*a* at or near an upper end thereof. The bracket assembly 31 may include first and second L-shaped brackets 32*a*, 32*b* and a plurality of connecting members 33*a*, 33*b* (e.g., saddle clamps). The pulley device 30*a* may be attached to the first bracket 32*a*, which, in turn, is coupled to the support member 12*a* via the connecting member 33*a*. The second bracket 32*b* may be attached (e.g., welded) to the first bracket 32*a* and may be coupled to the support member 12*a* via the connecting member 33*b*.

Figure 5:
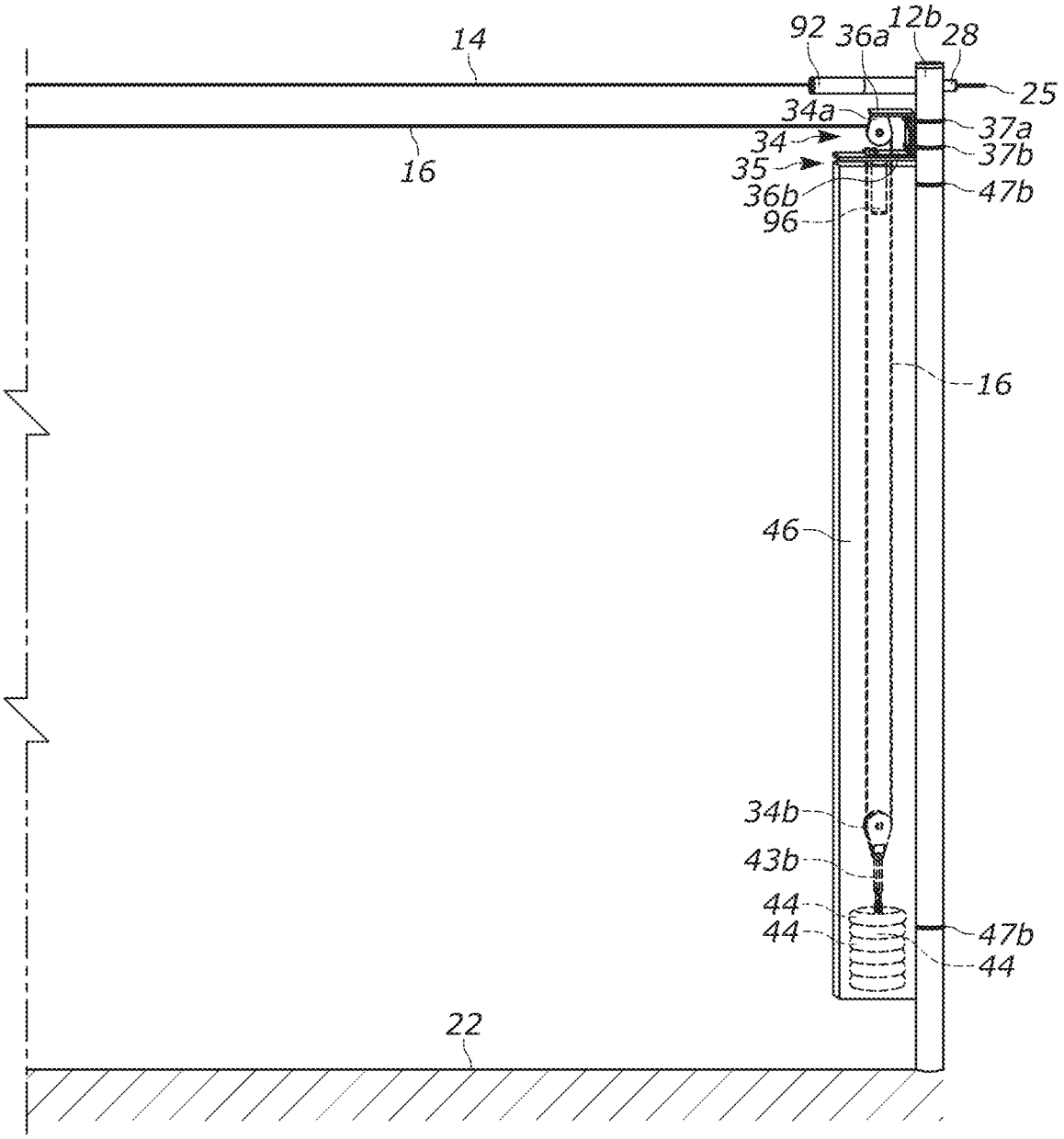
FIG. 5 is a front view of a second pulley system and a second support member of the tackling apparatus shown in FIG. 1.
Figure 6:
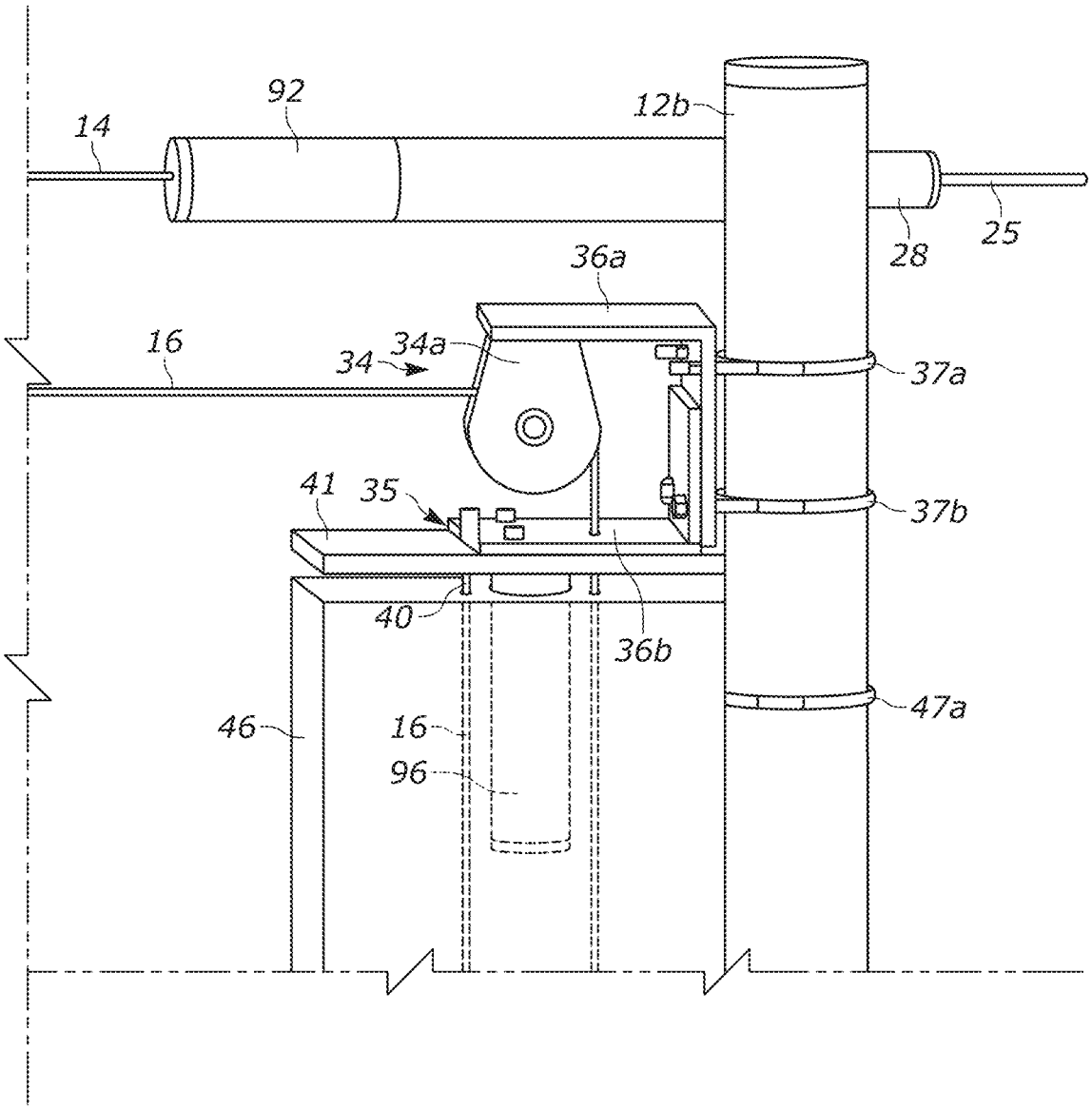
FIG. 6 is a front view of another bracket assembly of the tackling apparatus shown in FIG. 1.

With reference to FIGS. 5 and 6, a second pulley system 34 may be associated with the support member 12*b* and may include pulley devices 34*a*, 34*b*. The pulley device 34*a* may be attached to a bracket assembly 35, which, in turn, is coupled to the support member 12*b* at or near an upper end thereof. The bracket assembly 35 may include first and second L-shaped brackets 36*a*, 36*b* and a plurality of connecting members 37*a*, 37*b* (e.g., saddle clamps). The pulley device 34*a* may be attached to the first bracket 36*a*, which, in turn, is coupled to the support member 12*b* via the connecting member 37*a*. The second bracket 36*b* may be attached (e.g., welded) to the first bracket 36*a* and may be coupled to the support member 12*b* via the connecting member 37*b*.

The second cable 16 is positioned below the first cable 14 and extends between the pair of support members 12. The second cable 16 may have a length that is longer than a length of the first cable 14. The second cable 16 may support the bag 20 and may extend around the first pulley system 30 (FIG. 3) and the second pulley system 34 (FIG. 5). That is, the second cable 16 may extend around the pulley devices 30*a*, 30*b* and may include a first end portion 38 that is attached to a plate 39 fixed to the second bracket 32*b*. Similarly, the second cable 16 may extend around the pulley devices 34*a*, 34*b* and may include a second end portion 40 that is attached to a plate 41 fixed to the second bracket 36*b*. With reference to FIGS. 1, 3, 5, 9, 13 and 14, stacked weights 42 may be attached to the pulley device 30*b* via an attachment assembly 43*a* (FIGS. 1, 3, 9 and 13) and stacked weights 44 may be attached to the pulley device 34*b* via an attachment assembly 43*b* (FIGS. 1, 5, 9 and 14). In this way, the stacked weights 42, 44 may cooperate to act as a counter balance to the body 20 such that the body 20 may be suspended above the surface 22 a predetermined distance (e.g., a foot) prior to the bag 20 being tackled. That is, if the body 20 is 20 lbs, each of the stacked weights 42, 44 may total 10 lbs, thereby counterbalancing the body 20 and suspending the body 20 above the surface 22 the predetermined distance prior to the body 20 being tackled. The stacked weights 42, 44 may also provide resistance to a tackler that is tackling the body 20, thereby accurately simulating live game tackling.

With reference to FIGS. 1, 3, 5, 9, 13 and 14, the stacked weights 42 and the portion of the second cable 16 extending adjacent to the support member 12*a* may be housed in a first housing 45 (FIGS. 1, 3, 9 and 13) and the stacked weights 44 and the portion of the second cable 16 extending adjacent to the support member 12*b* may be housed in a second housing 46 (FIGS. 1, 5, 9 and 14). The first housing 45 may be attached to the support member 12*a* via a plurality of connecting members 47*a* (e.g., saddle clamps) and the second housing 46 may be attached to the support member 12*b* via a plurality of connecting members 47*b* (e.g., saddle clamps).

Figure 9:
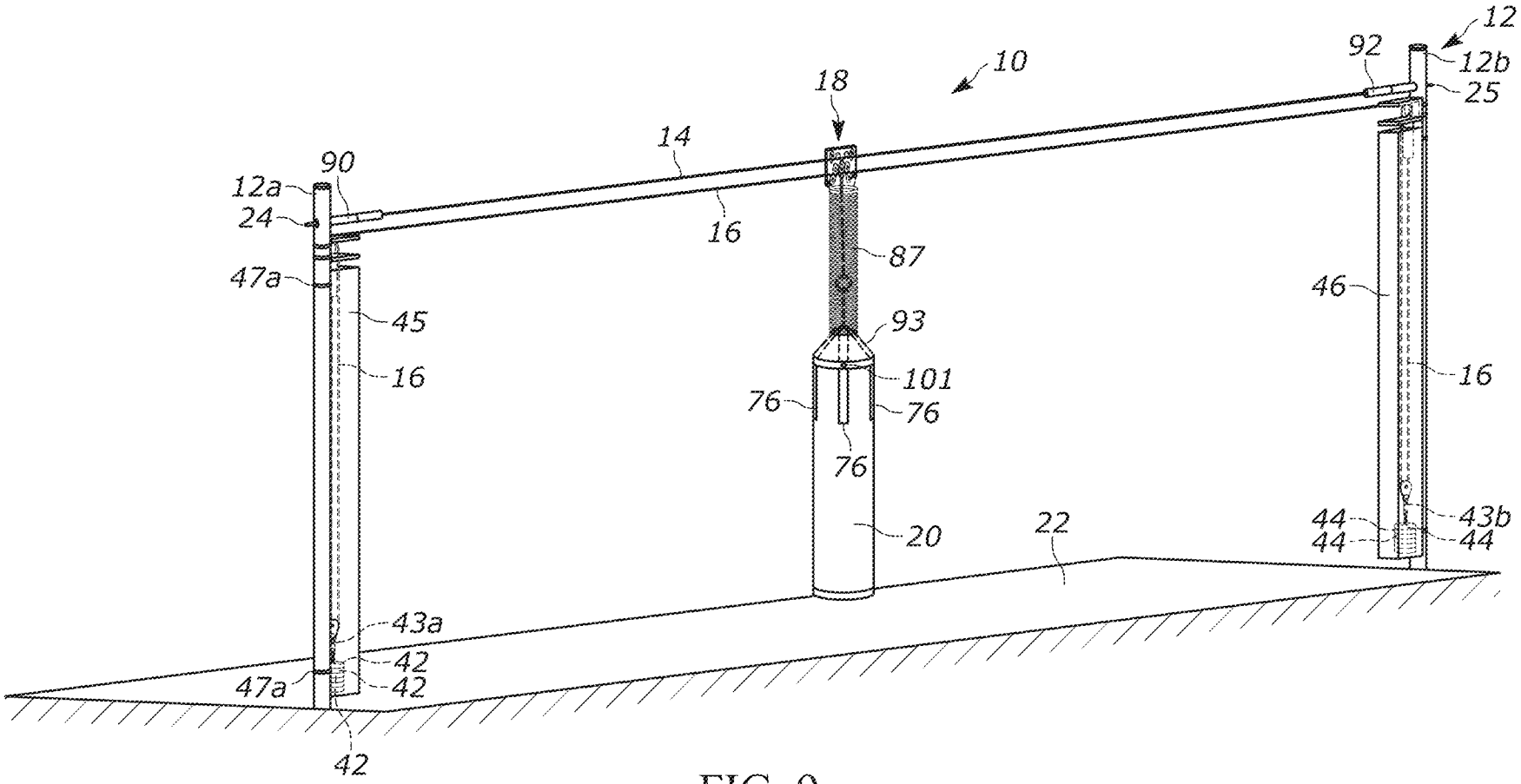
FIG. 9 is perspective view of the tackling apparatus with the tackling bag being propelled from the first support member toward the second support member and prior to the tackling bad being tackled.
Figure 10:
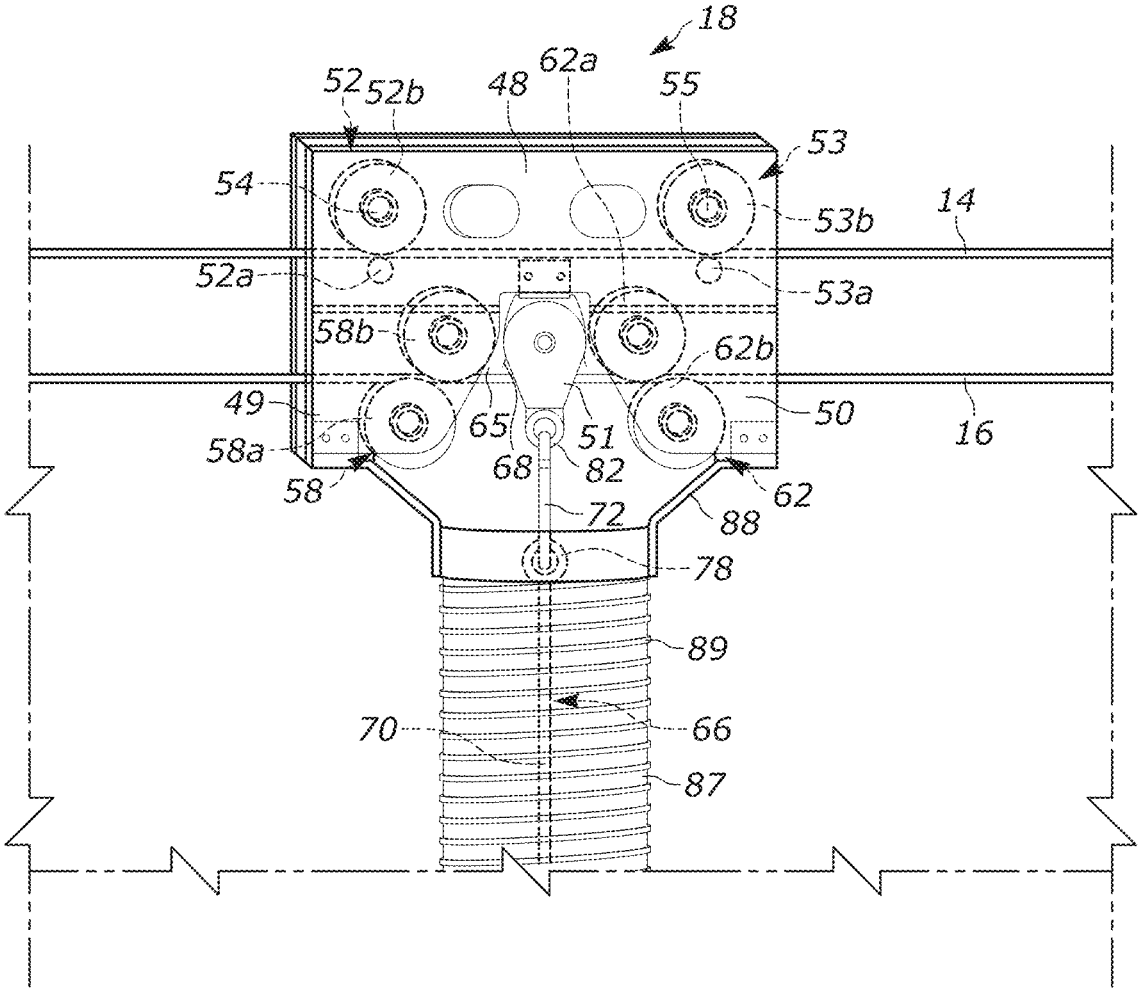
FIG. 10 is a front view of the trolley of FIG. 9.
Figure 11:
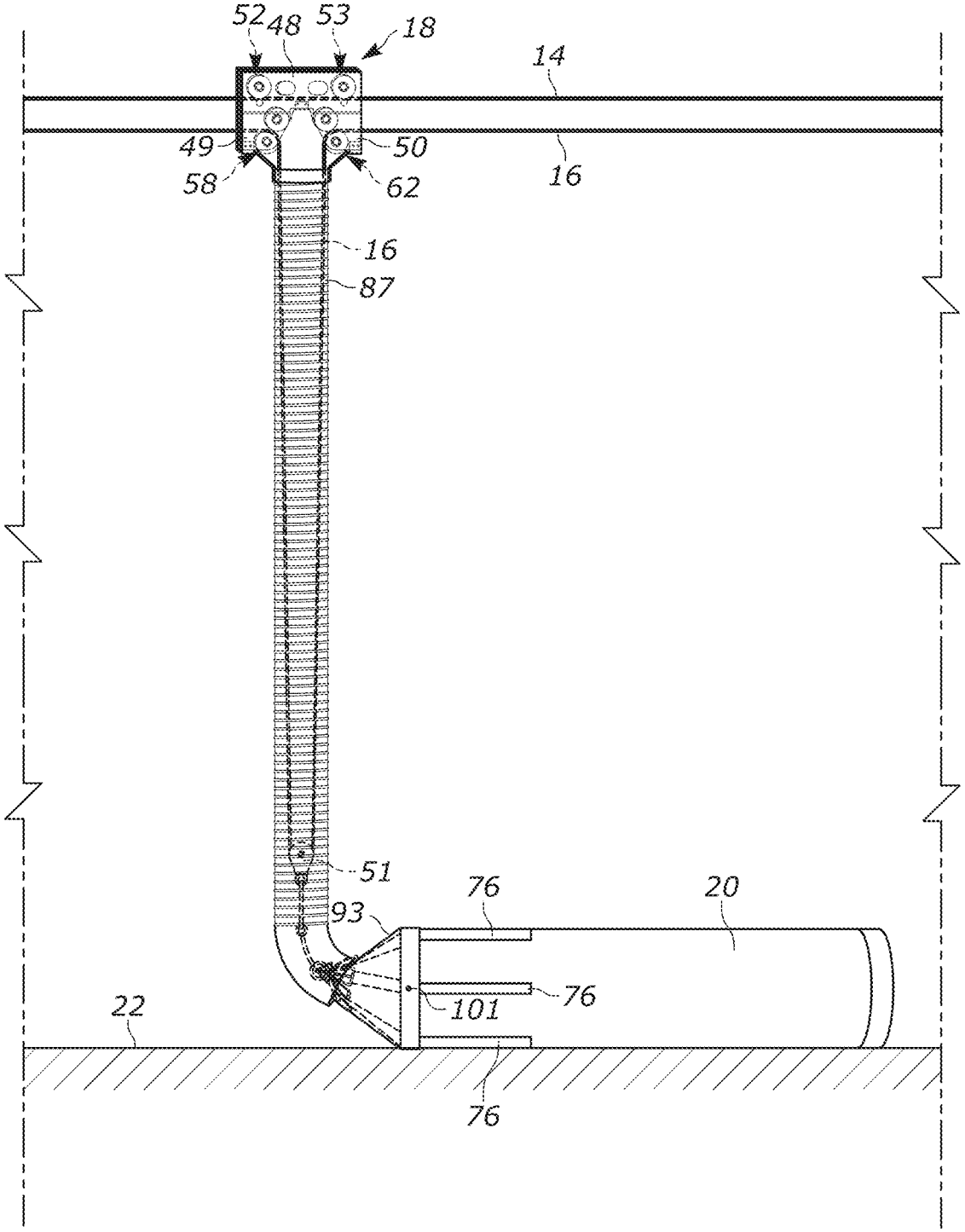
FIG. 11 is front view of the trolley, the attachment assembly and the tackling bag after the tackling bag is tackled.
Figure 12:
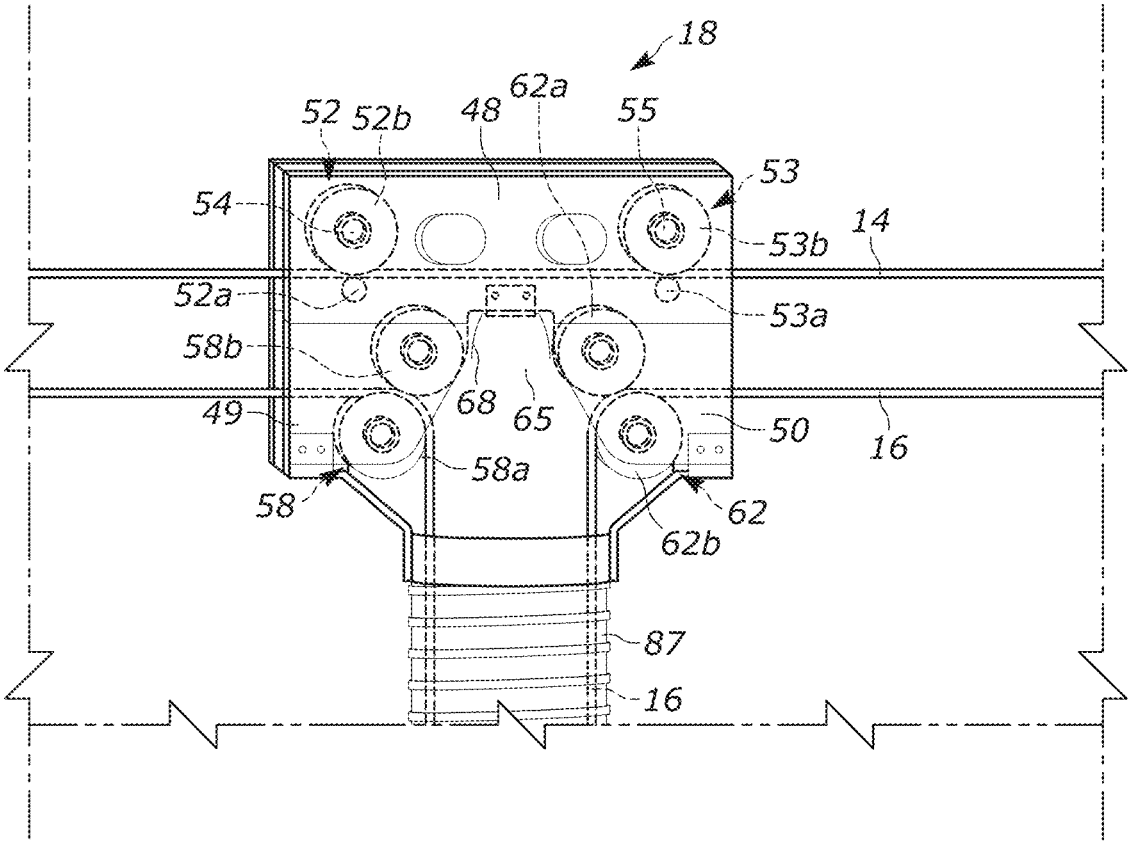
FIG. 12 is a front view of the trolley of FIG. 11.

As shown in FIGS. 1, 2, 7, and 9-12, the rolling mechanism 18 may be connected to the first cable 14 and the second cable 16 and may be configured to traverse the first cable 14 and the second cable 16. As shown in FIGS. 10 and 12, the rolling mechanism 18 may include a first wheel housing 48, a second wheel housing 49, a third wheel housing 50 and a pulley device 51. The first wheel housing 48 may be attached to the second and third wheel housings 49, 50 and may house a first wheel assembly 52 (comprising a peg 52*a* and a wheel 52*b*) and a second wheel assembly 53

(comprising a peg 53*a* and a wheel 53*b*). Each peg 52*a*, 53*a* may be attached to the first wheel housing 48 and each wheel 52*b*, 53*b* may be rotatably attached to the first wheel housing 48. The peg 52*a* may be aligned with an axle 54 of the wheel 52*b* and the peg 53*a* may be aligned with an axle 55 of the wheel 53*b*. The first cable 14 may extend between the first wheel assembly 52 and between the second wheel assembly 53. In this way, the first wheel housing 48 may traverse the first cable 14 from the first end 24 of the first cable 14 toward the second end 25 of the first cable 14.

As shown in FIGS. 10 and 12, the second wheel housing 49 may house a set of wheels 58 (comprising wheel 58*a* and wheel 58*b*). The wheels 58*a*, 58*b* may have the same diameter. Each wheel 58*a*, 58*b* may be rotatably attached to the second wheel housing 49. The set of wheels 58 may be offset from each other (i.e., axles of each wheel 58*a*, 58*b* are offset from one another). The second cable 16 may extend between the set of wheels 58. In this way, the second wheel housing 49 may traverse the second cable 16 from the first end portion 38 of the second cable 16 toward a second end portion 40 of the second cable 16.

As shown in FIGS. 10 and 12, the third wheel housing 50 may house a set of wheels 62 (comprising wheel 62*a* and wheel 62*b*). The wheels 62*a*, 62*b* may have the same diameter. Each wheel 62*a*, 62*b* may be rotatably attached to the third wheel housing 50. The set of wheels 62 may be offset from each other (i.e., axles of each wheel 62*a*, 62*b* are offset from one another). The second cable 16 may extend between the set of wheels 62. In this way, the third wheel housing 50 may traverse the second cable 16 from the first end portion 38 of the second cable 16 toward the second end portion 40 of the second cable 16.

As shown in FIG. 10, the first, second and third wheel housings 48, 49, 50 may define an opening 65 that the pulley device 51 may be disposed in. The pulley device 51 may be attached to the tackling bag 20 (via an attachment assembly 66) and may be movable in a vertical direction relative to the first, second and third wheel housings 48, 49, 50. The pulley device 51 may be positioned between the second and third wheel housings 49, 50 and may be removably attached to the first wheel housing 48 via a clip 68. The pulley device 51 may traverse the second cable 16 from the first end portion 38 of the second cable 16 toward the second end portion 40 of the second cable 16.

Figure 7:
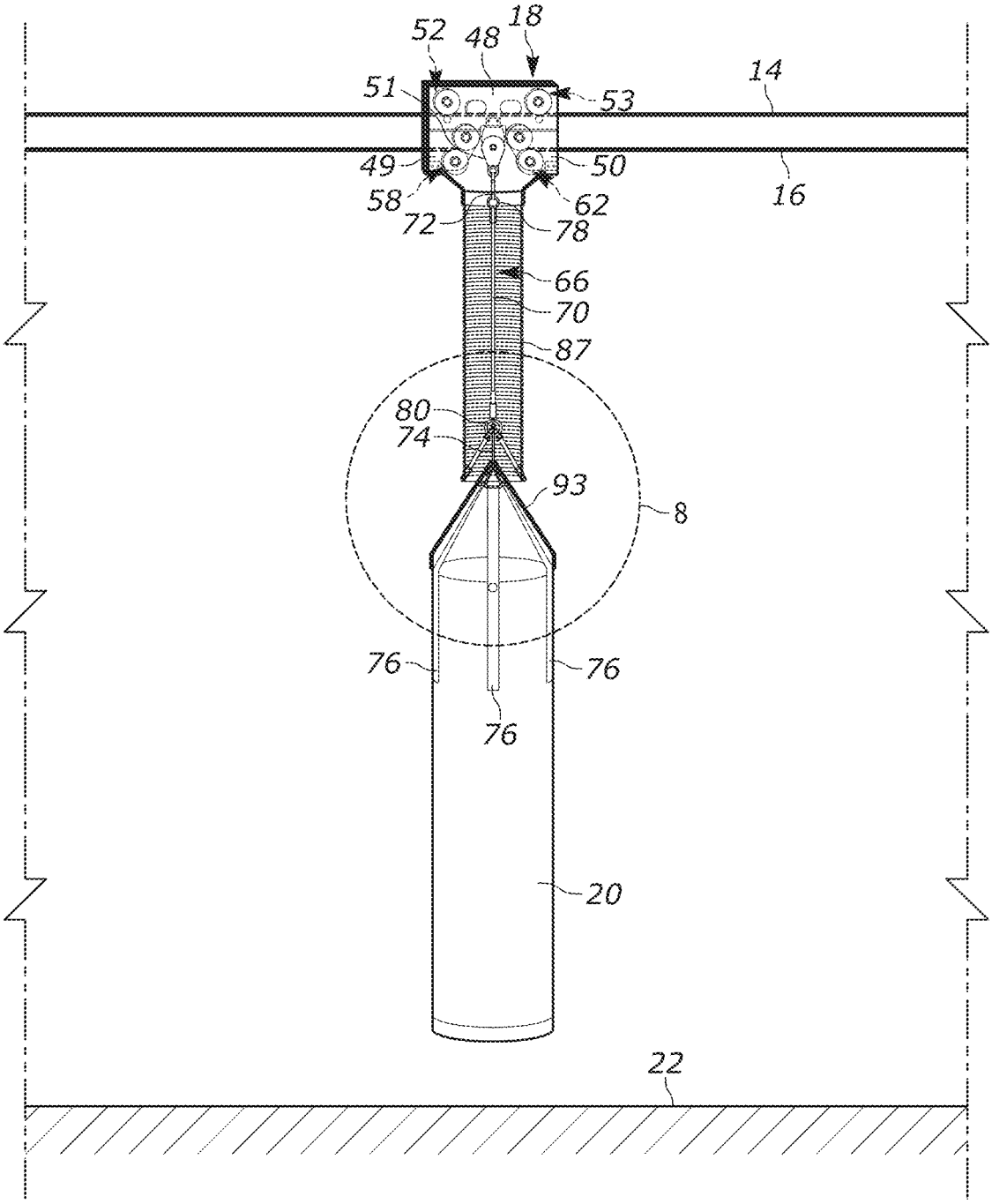
FIG. 7 is a front view of a trolley, an attachment assembly and the tackling bag of the tackling of FIG. 1.
Figure 8:
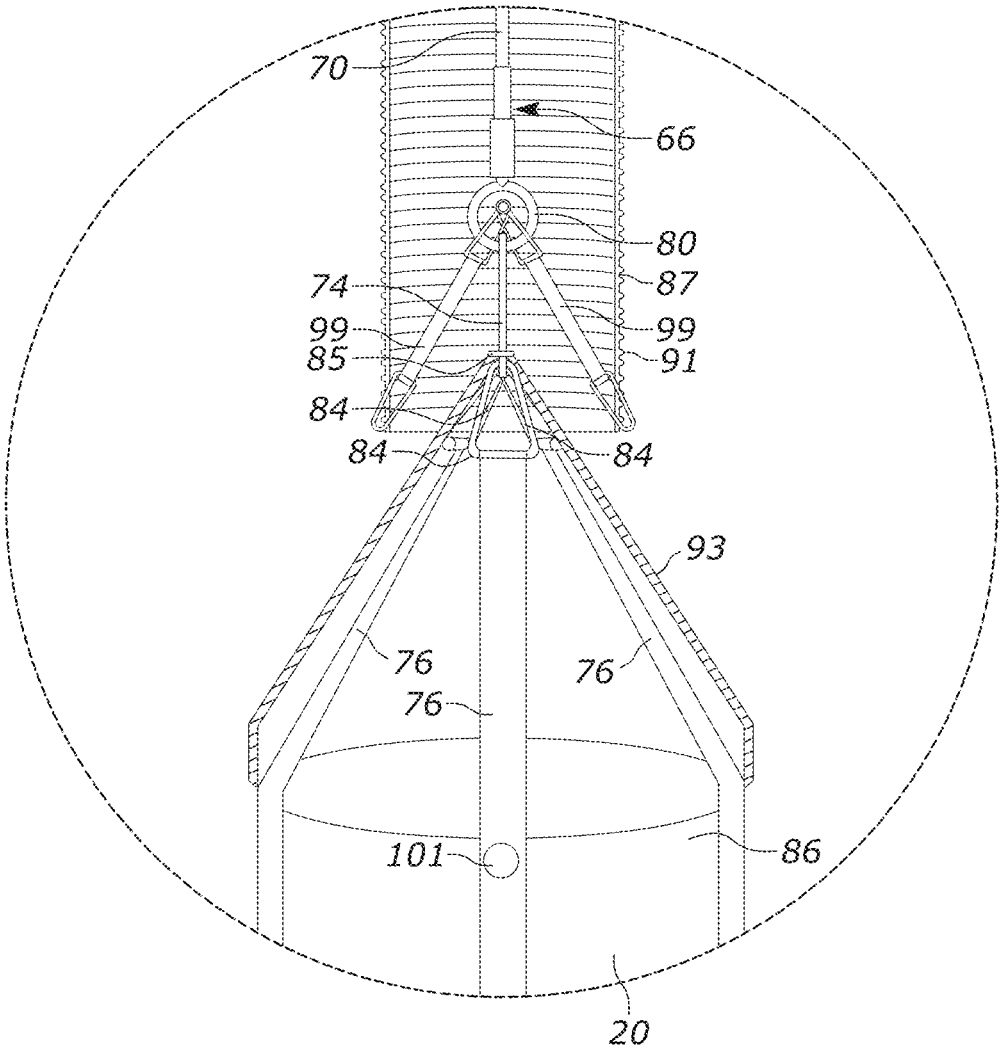
FIG. 8 is a close-up view of a portion of the attachment assembly indicated as area 8 in FIG. 7.

With reference to FIGS. 7, 8, 10, the attachment assembly 66 may include a cable 70, first and second connecting loops 72, 74 (e.g., carabiners) and a plurality of straps 76. The cable 70 may be stretchable and may include rings 78, 80 attached thereto at opposing ends. The ring 78 may be attached to the first connecting loop 72, which, in turn, is attached to a ring 82 of the pulley device 51. The ring 80 may be attached to the second connecting loop 74, which, in turn, is attached to the plurality of straps 76 (via a plurality of hooks 84). The plurality of straps 76 may be disposed around and attached to an upper end 86 of the tackling bag 20. In this way, the pulley device 51 may be attached to the tackling bag 20. The plurality of straps 76 may be made of an unstretchable material.

As shown in FIGS. 7 and 8, a sleeve or a cable shroud 87 may house the cable 70 and at least partially house the first and second connecting loops 72, 74. The sleeve 87 may be made of a stretchable material, for example. For example, the sleeve 87 may be 4 feet in length in its original state (i.e., unstretched) and may be allowed to stretch up to 12.5 feet in length. A first end 89 of the sleeve 87 may be attached to the rolling mechanism 18 via a bracket 88 and a second end 91 of the sleeve 87 may be attached to the ring 80 via strap assemblies 99. A cone-shaped shroud 93 may be attached to a shroud ring 85 and may be attached to the upper end 86 of the tackling bag 20 via attachments 101 (e.g., snap attachments). The shroud 93 may at least partially house the plurality of straps 76 and the plurality of hooks 84.

As shown in FIGS. 1, 2, 7 and 9, the tackling bag 20 may be suspended above the surface 22 a predetermined distance (e.g., a foot) and may be supported by the second cable 16 and the stacked weights 42, 44. The tackling bag 20 may be cylindrical-shaped and may be made of a polyester and/or neoprene material, for example. The tackling bag 20 may be 6 feet in height, for example, and may weigh between 20 lbs and 50 lbs. In some configurations, the tackling bag 20 may include apertures (not shown), which allows air to be released when the bag 20 is tackled, thereby softening the impact experienced by the tackler.

With continued reference to FIGS. 1-16, operation of the apparatus 10 will be described in detail. As shown in FIGS. 1 and 2, the tackling bag 20 may start out adjacent to the first support member 12*a* (or adjacent to the support member 12*b*). Bumpers 90 that are disposed on the first cable 14 at the first end 24 may extend past the first housing 45 such that the rolling mechanism 18 and the tackling bag 20 do not contact the first housing 45 and/or the first pulley system 30. Likewise, bumpers 92 that are disposed on the first cable 14 at the second end 25 may extend past the second housing 46 such that the rolling mechanism 18 and the tackling bag 20 do not contact the second housing 46 and/or the second pulley system 34.

As shown in FIG. 9, a user may propel the tackling bag 20 from a starting position near the support member 12*a* toward the support member 12*b* (or from the support member 12*b* toward the support member 12*a* if the tackling bag 20 starts out adjacent to the second housing 46). In this way, the rolling mechanism 18 may traverse the first cable 14 and the second cable 16 (i.e., the first wheel housing 48 may traverse the first cable 14 from the first end 24 of the first cable 14 toward the second end 25 of the first cable 14, and the wheel housings 49, 50 and the pulley device 51 may traverse the second cable 16 from the first end portion 38 of the second cable 16 toward the second end portion 40 of the second cable 16). While the tackling bag 20 is moving toward the support member 12*b*, a tackler (not shown) may tackle the moving tackling bag 20.

Figure 13:
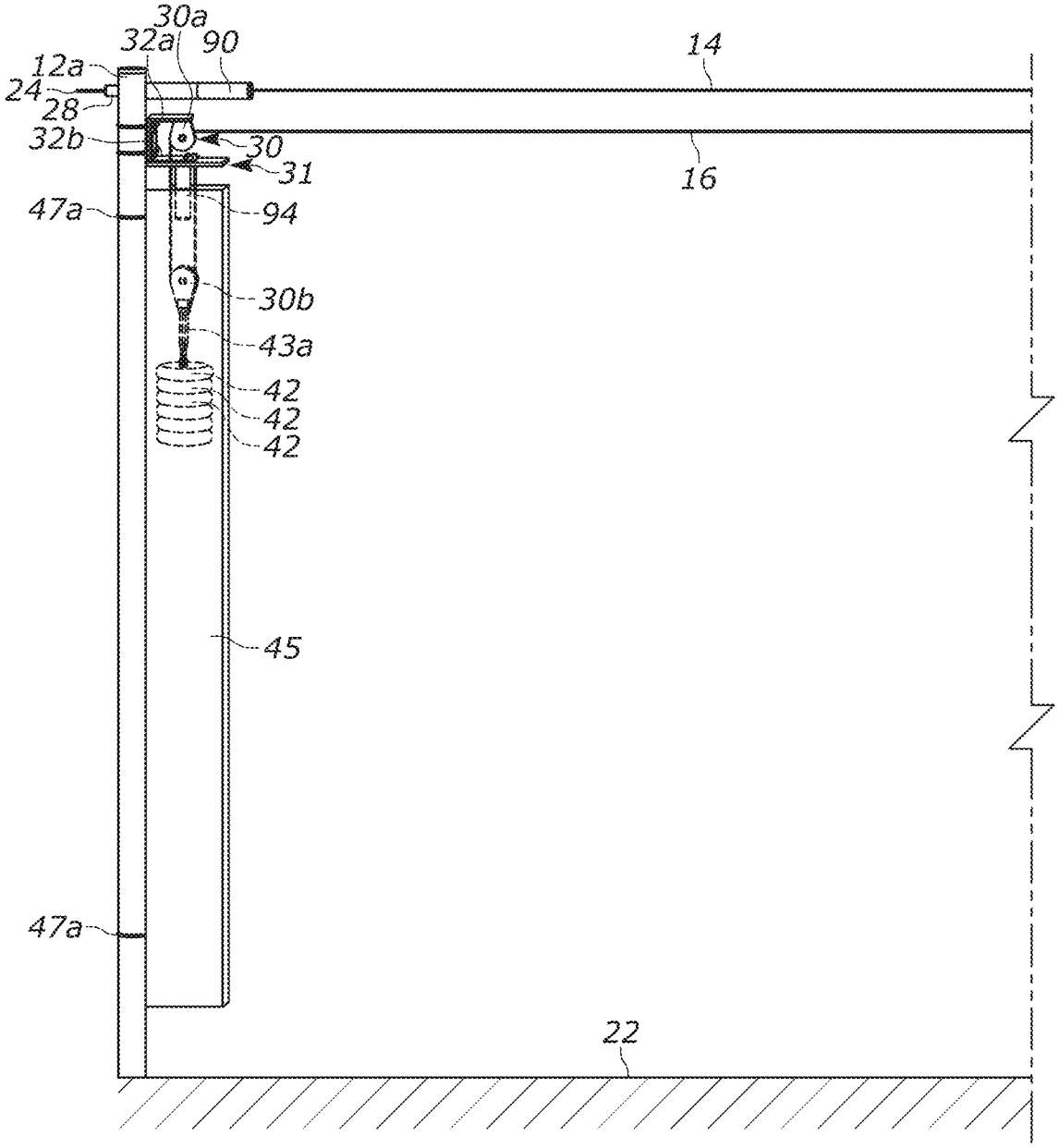
FIG. 13 is a front view of the first pulley system after the tackling bag is tackled.
Figure 14:
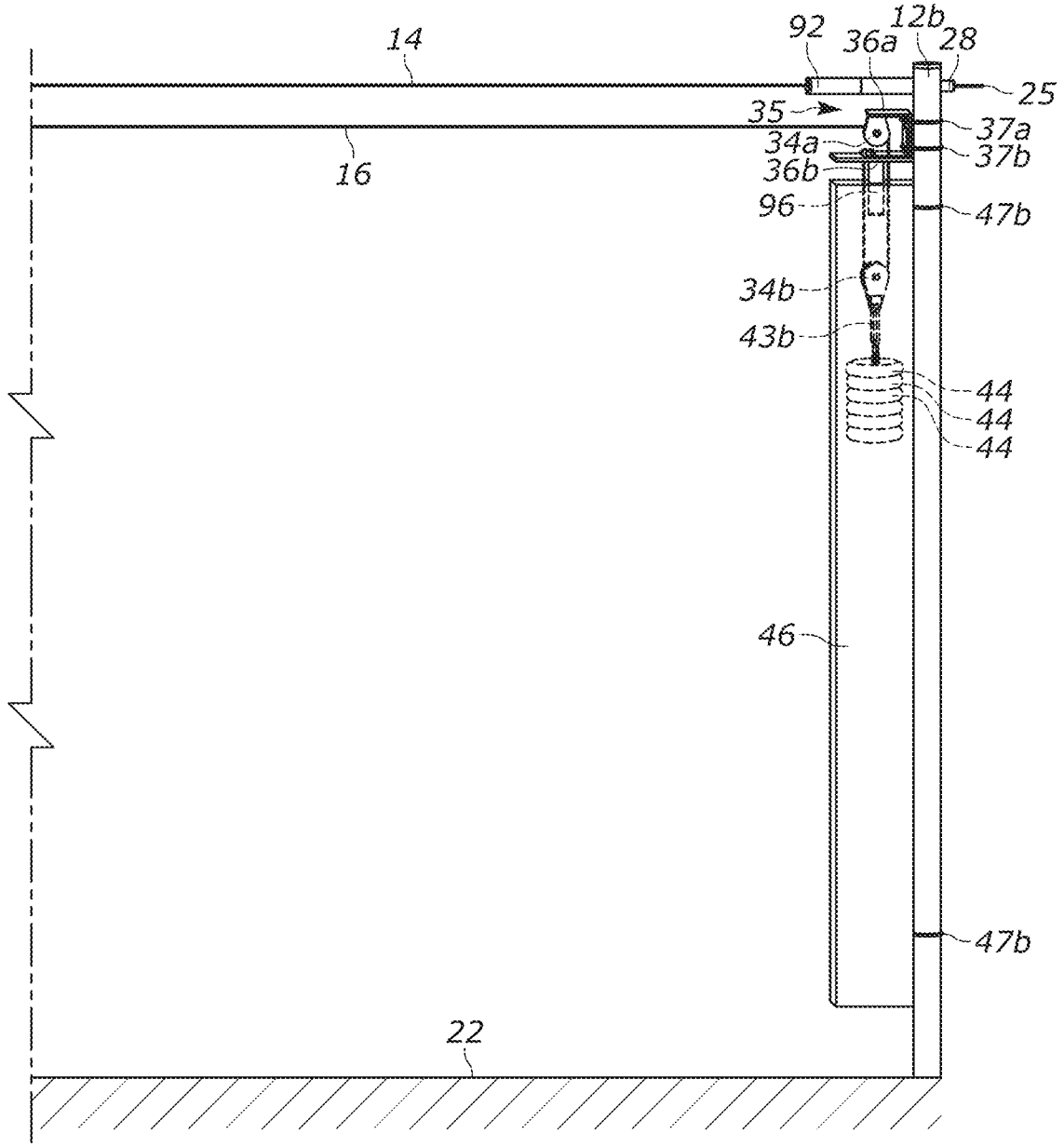
FIG. 14 is a front view of the second pulley system after the tackling bag is tackled.

As shown in FIG. 11, upon tackling the bag 20, the pulley device 51 may be detached from the clip 68 and move downwardly in the vertical direction relative to the first, second and third wheel housings 48, 49, 50, which, in turn, causes a portion of the second cable 16 to extend around the wheels 58*b*, 62*b* and move downwardly in the vertical direction. It should be understood that once the portion of the second cable 16 extends around the wheels 58*a*, 62*b* and moves downwardly in the vertical direction, the rolling mechanism 18 is prevented from continuing to traverse the first and second cables 14, 16. As shown in FIGS. 13 and 14, the stacked weights 42, 44 may move upwardly in the vertical direction (via the pulley systems 30, 34) when the portion of the second cable 16 is moving downwardly in the vertical direction, thereby providing resistance to the tackler that is tackling the bag 20.

As shown in FIGS. 3 and 4, a bumper 94 is attached to the plate 39 to provide a stopping point for the pulley device 30*b* and the stacked weights 42 moving upwardly in the vertical direction when the tackling bag 20 is tackled. Similarly, as shown in FIGS. 5 and 6, a bumper 96 is attached to the plate 41 to provide a stopping point for the pulley device 34*b* and the stacked weights 44 moving upwardly in the vertical direction when the tackling bag 20 is tackled.

Once the tackler disengages from the tackling bag 20, the tackling bag 20 returns to its original position (i.e., the tackling bag 20 is suspended above the surface 22 the predetermined distance). That is, once the tackler disengages from the tackling bag 20, the stacked weights 42, 44 move downwardly to their original position, which, in turn, causes the cable 16 to lift the tackling bag 20 off the surface 22 so that the tackling bag 20 is suspended above the surface 22 the predetermined distance. The user may move the tackling bag 20 back adjacent to the support member 12*a* and repeat the process over again. It should be understood that the cable shroud 87 may cover the cable 70 and may stretch to cover the portion of the second cable 16 that extends around the wheels 58*a*, 62*b* and moves downwardly in the vertical direction when the bag 20 is tackled.

Figure 15:
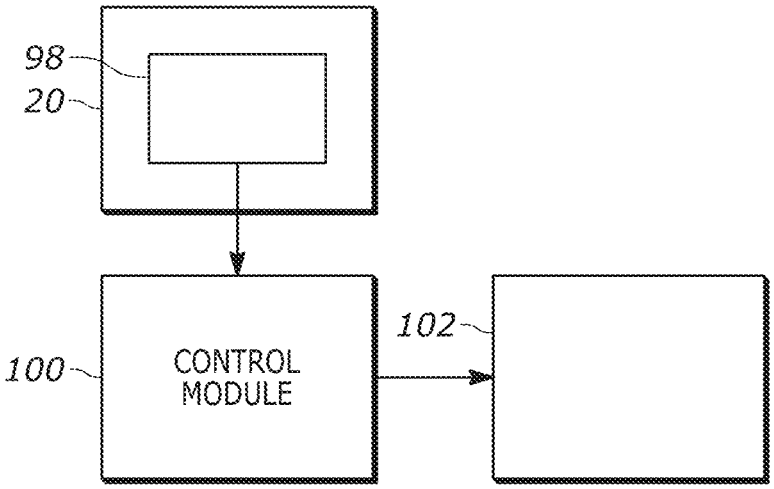
FIG. 15 is a block diagram illustrating communication between a control module, sensors and a notification system.

As shown in FIG. 15, a plurality of sensors 98 may be associated with the tackling bag 20 (e.g., the sensors 98 may be disposed at the upper end 86 and/or a middle portion of the tackling bag 20) and may be adapted to measure a parameter that is indicative of the force applied to the tackling bag 20 when a tackler strikes or tackles the bag 20. For example, the parameter may be a force or pressure applied to the tackling bag 20 when the tackler tackles the bag 20. In another example, the parameter may be an acceleration of the bag 20 when it is tackled, which is used along with the mass of the bag 20 to calculate the force ($F=m\times a$) applied to the tackling bag 20 by the tackler. It should be understood that the plurality of sensors 98 may be disposed at various other locations of the tackling bag 20 (e.g., a lower end of the tackling bag 20).

As shown in FIG. 15, a control module 100 may be in wired or wireless communication with the sensors 98 and may receive data from the sensors 98. The data may include the parameter that is indicative of the force applied to the tackling bag 20. When the control module 100 receives data from the sensors 98, the control module 100 may communicate the data to a notification system 102. The notification system 102 could be a computer, a mobile phone (e.g., smartphone), or a tablet, for example, or any other communication device or network of devices. The control module 100 may be in communication with the notification system 102 via, for example, an internet, Wi-Fi, Bluetooth®, Zigbee®, power-line carrier communication (PLCC), or cellular connection or any other wired or wireless communication protocol.

Figure 16:
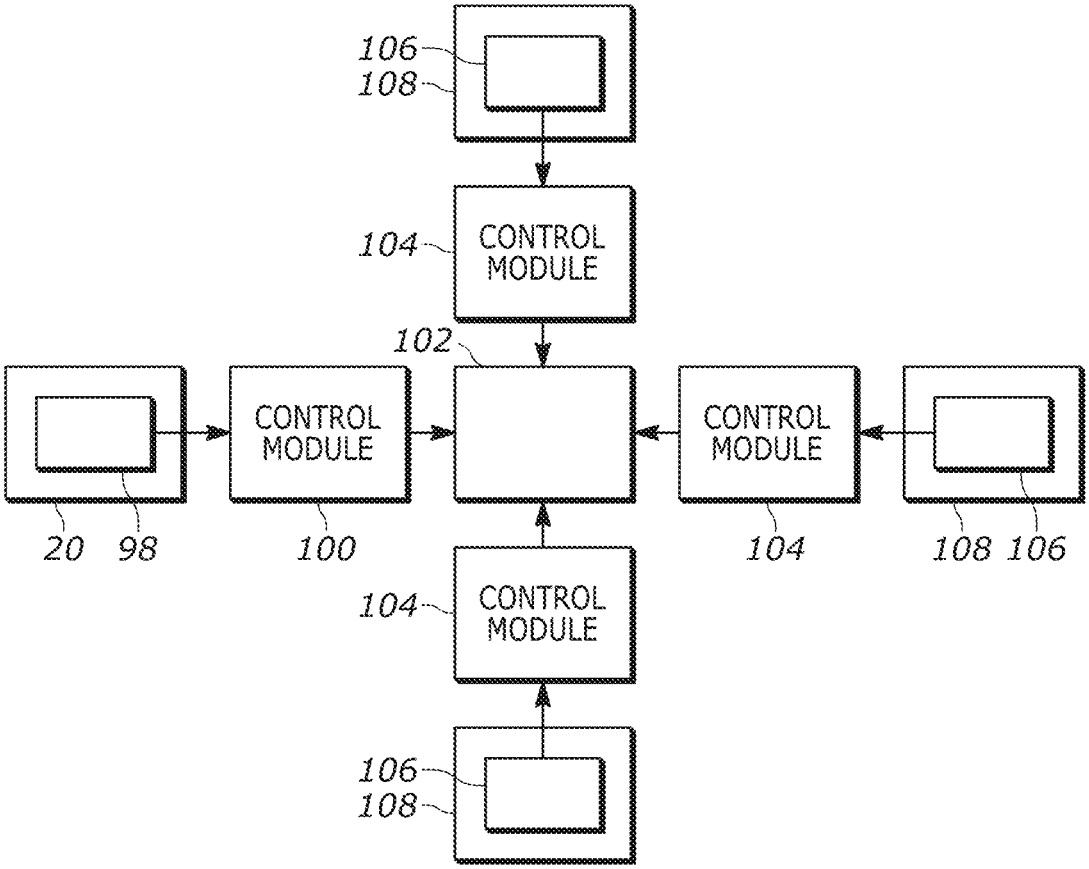
FIG. 16 is a block diagram illustrating communication between control modules, sensors and a notification system.
Figure 17:
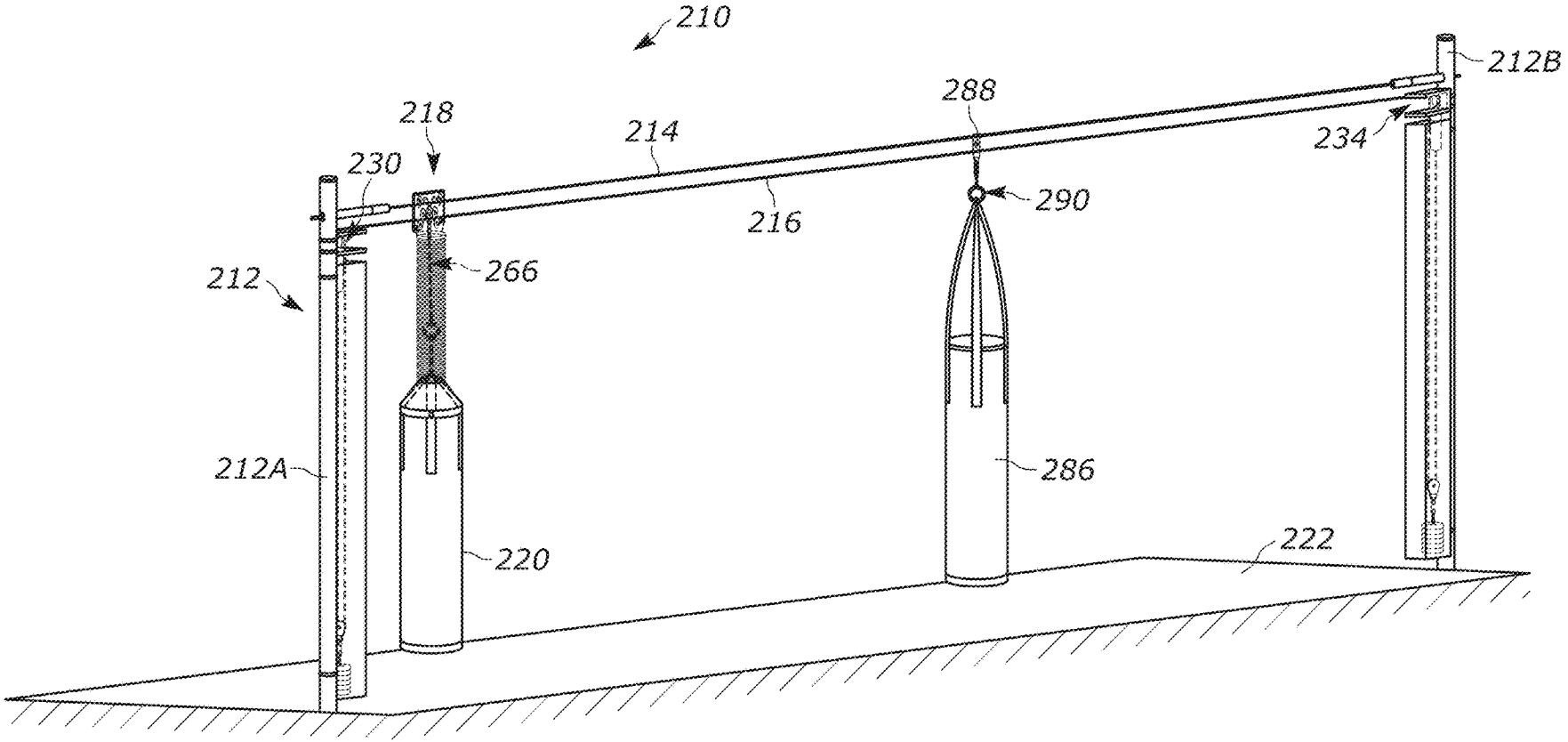
FIG. 17 is a perspective view of another tackling apparatus according to the principles of the present disclosure.
Figure 18:
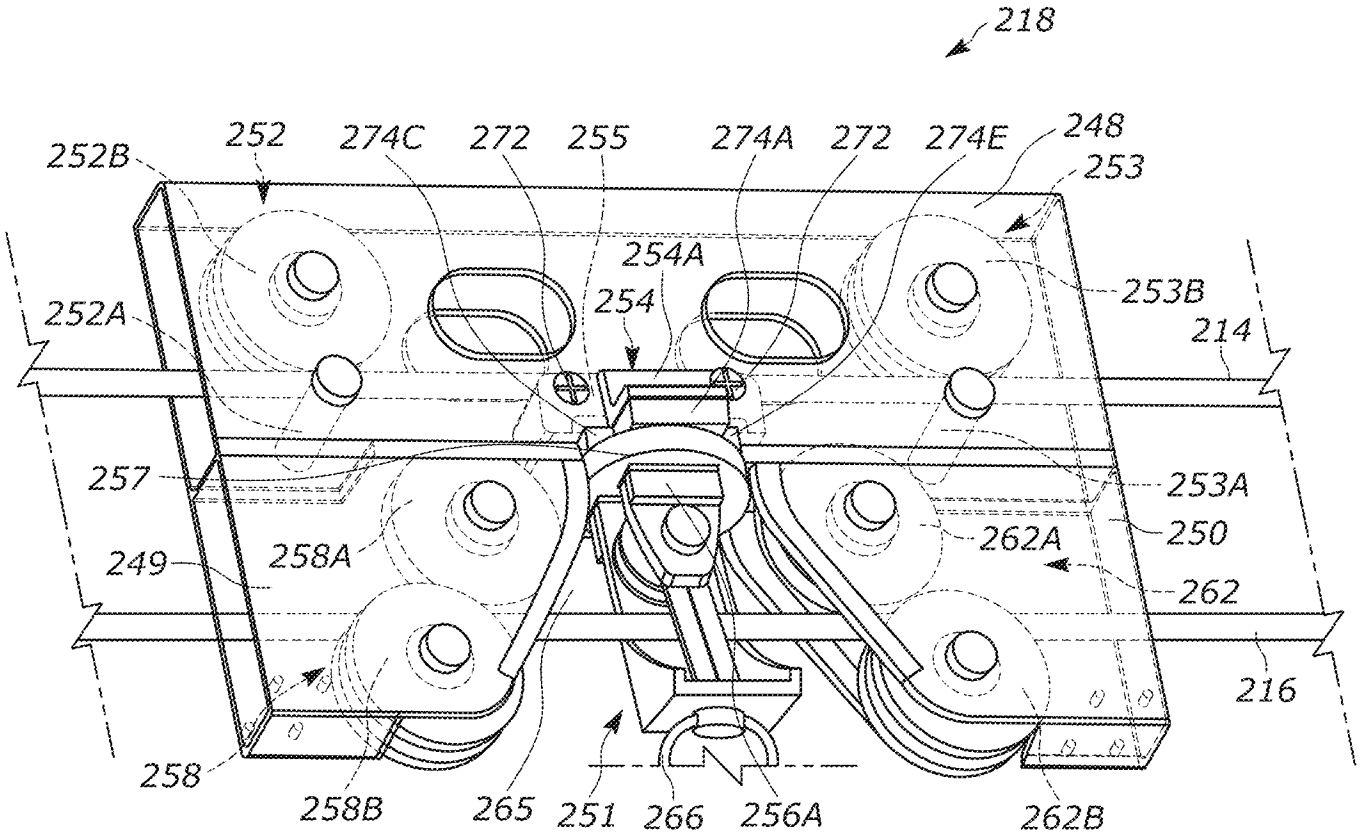
FIG. 18 is a front view of the trolley of FIG. 17 before a tackling bag of the apparatus is tackled.

With reference to FIGS. 15 and 16, the notification system 102 may include data from the control module 100 that is in communication with the sensors 98 associated with the tackling bag 20 and may also include data from other control modules 104 that are in communication with respective sensors 106 associated with respective tackling bags 108. The control modules 104 may be in communication with the notification system 102 via, for example, an internet, Wi-Fi, Bluetooth®, Zigbee®, power-line carrier communication (PLCC), or cellular connection or any other wired or wireless communication protocol. The control modules 104 may also be in wired or wireless communication with the respective sensors 106 and may receive data from the respective sensors 106. The data the control modules 104 receive from the respective sensors 106 may include parameters that are indicative of the force applied to the respective tackling bags 108. In this way, the notification system 102 may include data gathered for various tackling bags 20, 108 for users to view and may alert users when a record force is recorded and communicated to the notification system 102.

With reference to FIGS. 17-21, another apparatus 210 is provided. The structure and function of the apparatus 210 may be similar or identical to apparatus 10 described above, apart from any exceptions noted below.

The apparatus 210 may include a pair of elongated support structures or members 212 (comprised of support member 212*a* and support member 212*b*), first and second cables 214, 216, a trolley or rolling mechanism 218 and an elongated tackling bag or body 220. The structure and function of the pair of elongated support structures 212, the first and second cables and the tackling bag 220 may be similar or identical to that of the pair of elongated support structures 12, the first and second cables 14, 16 and the tackling bag 20, respectively, described above, and therefore, will not be described again in detail.

The apparatus 210 may further include first and second pulley systems 230, 234 and an attachment assembly 266. The structure and function of the first and second pulley systems 230, 234 and the attachment assembly 266 may be similar or identical to that of the first and second pulley systems 30, 34 and the attachment assembly 66, respectively, described above, and therefore, will not be described again in detail.

The rolling mechanism 218 may be connected to the first cable 214 and the second cable 216 and may be configured to traverse the first cable 214 and the second cable 216. The rolling mechanism 218 may include a first wheel housing 248, a second wheel housing 249, a third wheel housing 250 and a pulley device 251. The first wheel housing 248 may be attached to the second and third wheel housings 249, 250 and may house a first wheel assembly 252 (comprising a peg 252*a* and a wheel 252*b*) and a second wheel assembly 253 (comprising a peg 253*a* and a wheel 253*b*). Each peg 252*a*, 253*a* may be attached to the first wheel housing 48 and each wheel 252*b*, 253*b* may be rotatably attached to the first wheel housing 248. The first cable 214 may extend between the first wheel assembly 252 and between the second wheel assembly 253. In this way, the first wheel housing 248 may traverse the first cable 214 from a first end of the first cable 214 toward a second end of the first cable 214.

The second wheel housing 249 may house a set of wheels 258 (comprising wheel 258*a* and wheel 258*b*). The wheels 258*a*, 258*b* may have the same diameter. Each wheel 258*a*, 258*b* may be rotatably attached to the second wheel housing 249. The set of wheels 258 may be offset from each other (i.e., axles of each wheel 258*a*, 258*b* are offset from one another). The second cable 216 may extend between the set of wheels 258. In this way, the second wheel housing 249 may traverse the second cable 216 from a first end of the second cable 216 toward a second end of the second cable 216.

The third wheel housing 250 may house a set of wheels 262 (comprising wheel 262*a* and wheel 262*b*). The wheels 262*a*, 262*b* may have the same diameter. Each wheel 262*a*, 262*b* may be rotatably attached to the third wheel housing 250. The set of wheels 262 may be offset from each other (i.e., axles of each wheel 262*a*, 262*b* are offset from one another). The second cable 216 may extend between the set of wheels 262. In this way, the third wheel housing 250 may traverse the second cable 216 from the first end of the second cable 216 toward the second end of the second cable 216.

The first, second and third wheel housings 248, 249, 250 may define an opening 265 that the pulley device 251 may be disposed in. The pulley device 251 may be attached to the tackling bag 220 (via an attachment assembly 266) and may be movable in a vertical direction relative to the first, second and third wheel housings 248, 249, 250. The pulley device 251 may be positioned between the second and third wheel housings 249, 250 and may be removably attached to the first wheel housing 248 via a coupling assembly 254.

Figure 19:
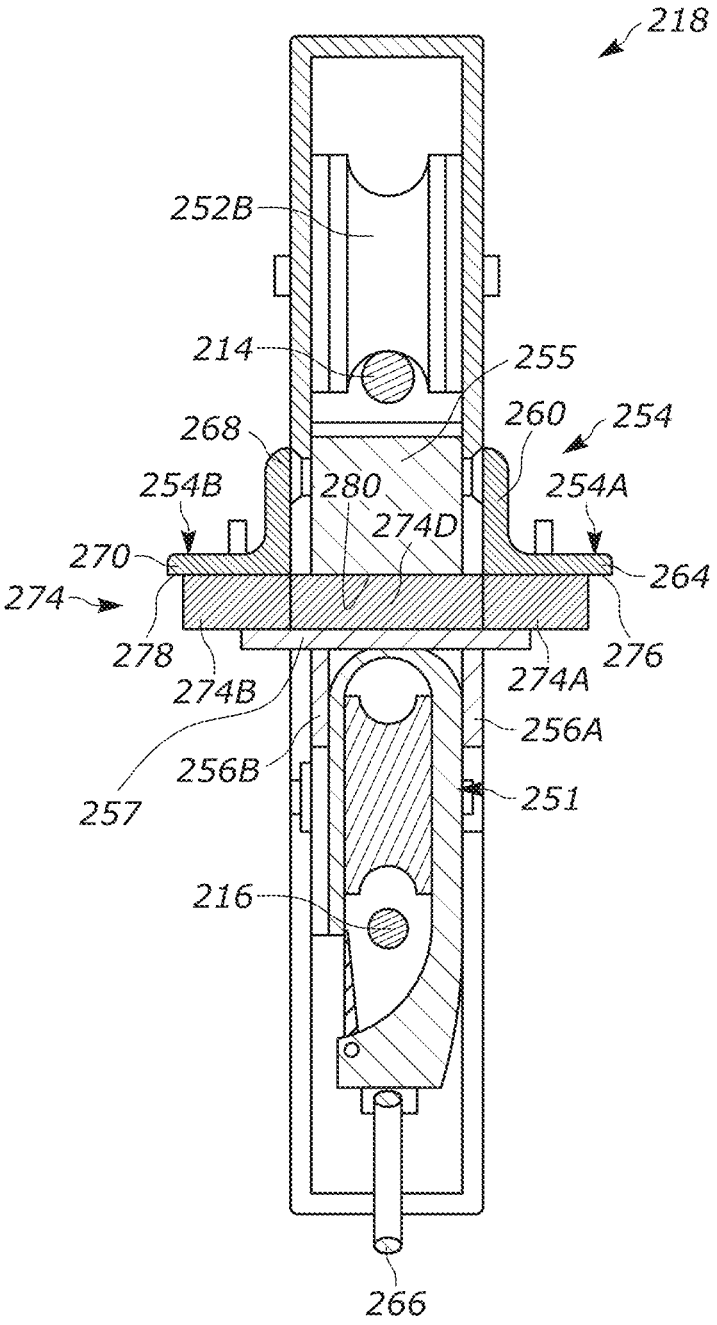
FIG. 19 is a cross-sectional view of the trolley of FIG. 17.
Figure 20:
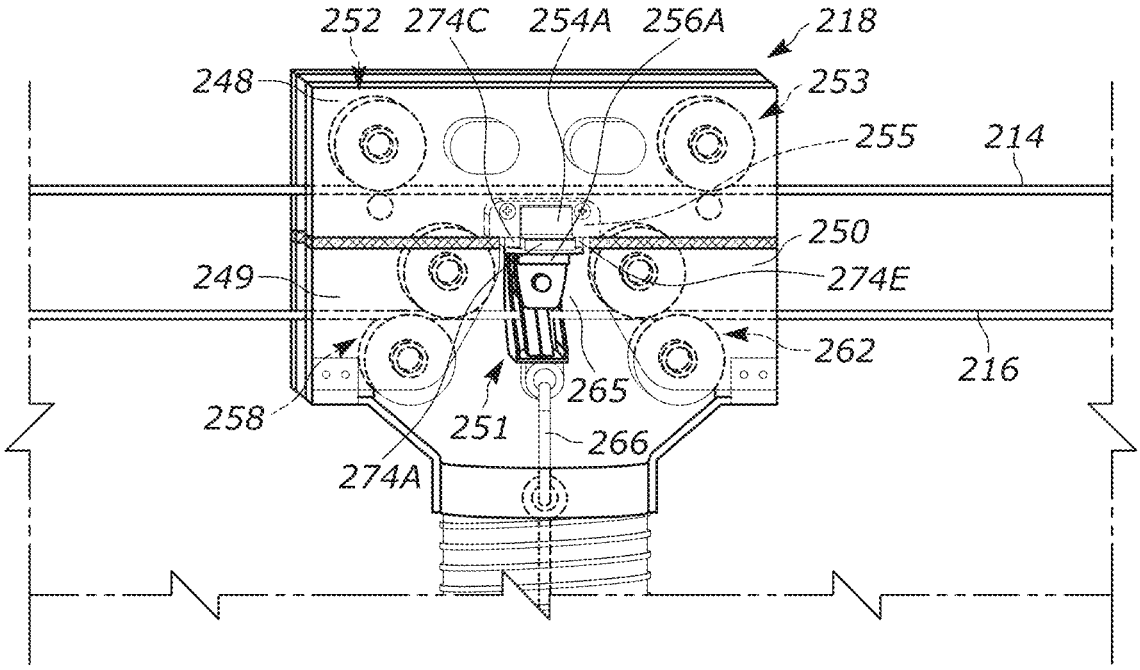
FIG. 20 is a perspective view of the trolley of FIG. 17 before the tackling bag is tackled.
Figure 21:
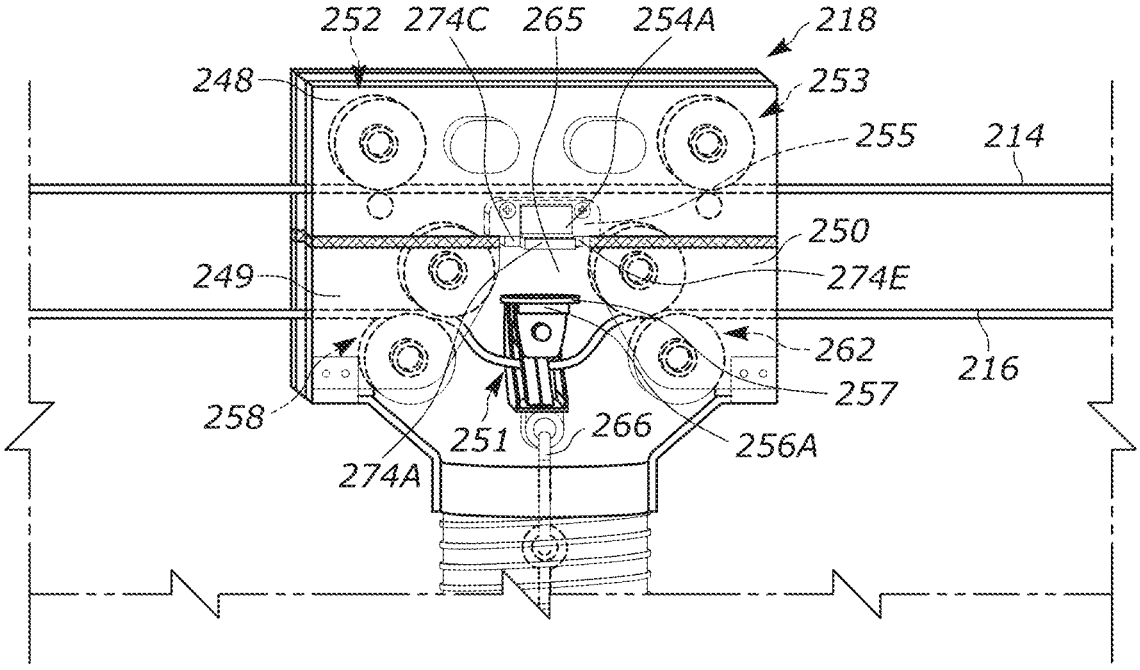
FIG. 21 is a perspective view of the trolley of FIG. 17 after the tackling bag is tackled.

The coupling assembly 254 may include angle brackets 254*a*, 254*b*, a housing member 255, pulley plates 256*a*, 256*b* and a coupling plate 257. The angle brackets 254*a*, 254*b* are made of a metallic material and have an L-shape. As shown in FIG. 19, the bracket 254*a* may be attached to a first side of the first wheel housing 248 (i.e., the bracket 254*a* is located externally to the first wheel housing 248) and includes a first member 260 and a second member 264 that extends perpendicular to the first member 260 (i.e., the second member 264 has a plane that extends perpendicular to a plane of the first member 260 and the first wheel housing 248). The first member 260 is attached (e.g., welded) to the first side of the first wheel housing 248.

The bracket 254*b* may be attached to a second side of the first wheel housing 248 that is opposite the first side (i.e., the bracket 254*b* is located externally to the first wheel housing 248) and includes a first member 268 and a second member 270 that extends perpendicular to the first member 268 (i.e., the second member 270 has a plane that extends perpendicular to a plane of the first member 268 and the first wheel housing 248). The first member 268 is attached (e.g., welded) to the second side of the first wheel housing 248.

The housing member 255 is housed within the first wheel housing 248 and is attached to the housing member 255 via fasteners 272. The pulley plate 256*a* is attached (e.g., welded) to a first side of the pulley device 251 and the pulley plate 256*b* is attached (e.g., welded) to a second side of the pulley device 251 that is opposite the first side. The coupling plate 257 is made of a metallic material and is attached (e.g., welded) to the plates 256*a*, 256*b*. The coupling plate 257 extends parallel to the second member 264 of the bracket 254*a* and the second member 270 of the bracket 254*b*.

A plurality of magnets 274 (comprising magnets 274*a*, 274*b*, 274*c*, 274*d* and 274*e*) may be coupled to the brackets 254*a*, 254*b* and the housing member 255. That is, magnet 274*a* may be attached to a planar surface 276 of the second member 264 (via fasteners), magnet 274*b* may be attached to a planar surface 278 of the second member 270 (via fasteners) and magnets 274*c*, 274*d*, 274*e* may be attached to a planar surface 280 of the housing member 255 (via fasteners). The magnets 274 may be neodymium magnets, for example. The magnets 274 may be attracted to the metallic material of the coupling plate 257 and may produce a magnetic force urging the pulley device 251 against the magnets 274 and away from the second cable 216. In this way, the pulley device 251 does not ride along the second cable 216 (i.e., the pulley device 251 and the second cable 216 are separated from each other) when the bag 220 is propelled from one of the support members 212*a*, 212*b* towards the other of the support members 212*a*, 212*b*, which, in turn, increases the bag 220 speed from the one of the support members 212*a*, 212*b* towards the other of the support members 212*a*, 212*b*.

While the tackling bag 220 is moving from one of the support members 212*a*, 212*b* towards the other of the support members 212*a*, 212*b*, a tackler (not shown) may tackle the moving tackling bag 220. Upon tackling the bag 220, the pulley device 251 and the coupling plate 257 may be detached from the magnets 274 and move downwardly in the vertical direction relative to the first, second and third wheel housings 248, 249, 250 as described above. Once the tackler disengages from the tackling bag 220, the tackling bag 220 returns to its original position (i.e., the coupling plate 257 is attached to the magnets 274 and the tackling bag 220 is suspended above the surface 222 a predetermined distance).

In some configurations, the apparatus 210 may include a utility bag 286 that may be suspended above the surface 222 a predetermined distance (e.g., a foot) and may be supported by the first cable 214 (via a trolley 288 and connecting assembly 290). The utility bag 286 may be propelled from a starting position near one of the support members 212*a*, 212*b* towards the other of the support members 212*a*, 212*b* independently of the tacking bag 220. The utility bag 286 may be cylindrical-shaped and may be made of a polyester and/or neoprene material, for example. The utility bag 286 may be 6 feet in height, for example, and may be between 50 lbs and 90 lbs. The trolley 288 may be connected to the first cable 214 and may be configured to traverse the first cable 214. The connecting assembly 290 may be coupled to the trolley 288 and the utility bag 290.

The utility bag 286 provides more functionality to the apparatus 210, thereby allowing tacklers to more accurately simulate game time situations. For example, in one drill, one user may propel the utility bag 286 from one of the support members 212*a*, 212*b* towards the other of the support members 212*a*, 212*b* while another user simultaneously propels the tacking bag 220 from the one of the support members 212*a*, 212*b* towards the other of the support members 212*a*, 212*b*. In such drill, the tackler must shed (i.e., escape) the utility bag 286 and then tackle the tackling bag 220.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

In this application, including the definitions below, the term 'module' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects.

The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "for."

What is claimed is:

1. An apparatus comprising:

a rolling mechanism with a first wheel housing, a second wheel housing, and a third wheel housing, a magnet attached to the rolling mechanism, a metallic plate attached to the magnet, and a pulley device attached to the metallic plate, wherein the pulley device is removably coupled to the rolling mechanism via the attachment between the metallic plate and the magnet.

2. The apparatus of claim 1, further comprising:

a pair of support members, a cable attached to and extending between the pair of support members, wherein the rolling mechanism is configured to traverse the cable between the pair of support members.

3. The apparatus of claim 2, the rolling mechanism comprising a first wheel housing, a second wheel housing, and a third wheel housing, wherein the second and third wheel housing traverse the cable.

4. The apparatus of claim 3, wherein the magnet is attached to the first wheel housing.

5. The apparatus of claim 1, wherein the magnet is a neodymium magnet.

6. The apparatus of claim 2, further comprising a first pulley system associated with one of the pair of support members, a second pulley system associated with the other of the pair of support members, wherein the cable extends around the first pulley system and the second pulley system.

7. The apparatus of claim 6, further comprising:

a first stack of weights attached to a pulley of the first pulley system, a second stack of weights attached to another pulley of the second pulley system.

8. The apparatus of claim 2, further comprising:

a magnet coupled to the rolling mechanism and urging the pulley device away from the cable.

9. The apparatus of claim 2, further comprising:

a second cable attached to and extending between the pair of support members, the rolling mechanism being also connected to the second cable and configured to travers the second cable from a first end of the second cable to a second end of the second cable.

10. The apparatus of claim 2, further comprising:

a second rolling mechanism connected to the cable and configured to traverse the cable.

11. An apparatus comprising:

a pair of support members fixedly coupled to a surface, a cable attached to and extending between the pair of support members, a rolling mechanism connected to the cable and configured to traverse the cable from a first end of the cable to a second end of the cable, a pulley device removably coupled to the rolling mechanism, and at least one magnet coupled to the rolling mechanism and urging the pulley device away from the cable.

12. The apparatus of claim 11, wherein the rolling mechanism includes first, second, and third wheel housings, and wherein the second and third wheel housings traverse the cable.

13. The apparatus of claim 12, wherein the pulley device is configured to move downwardly relative to the first and second wheel housings.

14. The apparatus of claim 12, wherein the first, second, and third wheel housing defines a spaces, and wherein at least one magnet is received in the space and is attached to the first wheel housing.

15. The apparatus of claim 12, further comprising a housing member disposed within the first wheel housing and attached to the first wheel housing, wherein the at least one magnet is coupled to the housing member.

16. The apparatus of claim 12, wherein the at least one magnet includes a plurality of magnets coupled to the rolling mechanism and urging the pulley device away from the cable when the rolling mechanism traverses the cable from a first end of the cable to a second end of the cable.

17. A apparatus comprising:

a pair of support members fixedly coupled to a surface, a cable attached to and extending between the pair of support members, a second cable attached to and extending between the pair of support members, a first rolling mechanism connected to the cable and configured to traverse the cable from a first end of the cable toward a second end of the cable, and connected to the second cable and configured to traverse the second cable from a first end of the cable toward a second end of the cable, a second rolling mechanism connected to the cable and configured to traverse the cable from a first end of the cable toward a second end of the cable, and connected to the second cable and configured to traverse the second cable from the first end of the cable toward the second end of the cable, a pulley device removably coupled to the first rolling mechanism, and at least one magnet coupled to the rolling mechanism and urging the pulley device away from the cable.

18. The apparatus of claim 17, further comprising a first pulley system associated with one of the pair of support members, a second pulley system associated with the other of the pair of support members, wherein the cable extends around the first pulley system and the second pulley system.

19. The apparatus of claim 18, further comprising:

a first stack of weights attached to a pulley of the first pulley system, a second stack of weights attached to another pulley of the second pulley system.

20. The apparatus of claim 19, wherein the rolling mechanism includes first, second, and third wheel housings, and wherein the second and third wheel housings traverse the cable.

* * * * *